US006446396B1

(12) United States Patent
Marangoni et al.

(10) Patent No.: US 6,446,396 B1
(45) Date of Patent: Sep. 10, 2002

(54) WALL SYSTEM

(75) Inventors: Lorie Marangoni, Weston; Geoffrey Milligan, East York; Zoran Baic, Mississauga; Christine Dominik, Toronto; Steven Verbeek, Aurora; Genadij Makarewicz, Brampton; Ulf Stahmer; Nicolas Koeppe, both of Toronto, all of (CA)

(73) Assignee: Teknion Furniture Systems Limited, Downsview (CA)

( * ) Notice: Subject to any disclaimer, the term of this patent is extended or adjusted under 35 U.S.C. 154(b) by 0 days.

(21) Appl. No.: 09/585,484

(22) Filed: Jun. 2, 2000

Related U.S. Application Data

(60) Provisional application No. 60/137,503, filed on Jun. 4, 1999.

(51) Int. Cl.[7] ..... A47F 10/00

(52) U.S. Cl. ..... 52/36.1; 52/36.4; 52/220.7; 52/238.1; 108/50.02

(58) Field of Search ..... 52/36.1, 239, 36.4–36.6, 52/220.7, 238.1; 108/152, 50.02, 182; 16/105, 229; 211/90.02, 90.01, 103

(56) References Cited

U.S. PATENT DOCUMENTS

| | | | | | |
|---|---|---|---|---|---|
| 3,786,534 | A | * | 1/1974 | Ferguson | 16/176 |
| 4,208,850 | A | | 6/1980 | Collier | 52/285 |
| 4,395,856 | A | | 8/1983 | Smith et al. | 52/239 |
| 4,437,280 | A | | 3/1984 | Collier | 52/285 |
| 4,833,848 | A | | 5/1989 | Guerin | 52/242 |
| 4,881,353 | A | * | 11/1989 | Braendel et al. | 52/239 |
| 5,038,539 | A | * | 8/1991 | Kelley et al. | 52/239 |
| 5,159,793 | A | | 11/1992 | Deugo et al. | 52/126.1 |
| 5,323,579 | A | * | 6/1994 | Ruff | 52/455 |
| 5,364,311 | A | | 11/1994 | Chou | 472/62 |
| 5,377,461 | A | | 1/1995 | DeGrada et al. | 52/126.4 |
| 5,433,046 | A | | 7/1995 | MacQuarrie et al. | 52/238.1 |
| 5,472,103 | A | * | 12/1995 | Merl | 211/187 |
| 5,775,745 | A | * | 7/1998 | Hoppe et al. | 292/138 |
| 5,833,332 | A | * | 11/1998 | Marshall et al. | 312/223.3 |
| 5,839,240 | A | * | 11/1998 | Elsholz | 52/242 |
| 5,848,498 | A | * | 12/1998 | Szabo, Sr. et al. | 52/36.1 |
| 5,875,594 | A | * | 3/1999 | Hellwig et al. | 52/220.7 |
| 5,906,079 | A | * | 5/1999 | Brickner | 52/239 |
| 5,974,742 | A | * | 11/1999 | Schreiner et al. | 52/36.1 |
| 6,042,203 | A | * | 3/2000 | Bogucki | 312/223.3 |
| 6,164,467 | A | * | 12/2000 | DePottey et al. | 211/189 |

* cited by examiner

*Primary Examiner*—Beth A. Stephan
*Assistant Examiner*—Naoko Slack
(74) *Attorney, Agent, or Firm*—Bereskin & Parr

(57) ABSTRACT

A wall system for partitioning interior space within a building includes an internal frame made up of vertical posts and horizontal rails extending between the posts. Panels providing a fascia defining a covering on the frame are coupled to the panel by plug-in connectors. The panels may include "smart" elements or fascias providing writing or tack board surfaces, or an accessory element to which shelves or other accessories can be coupled. Heavier capacity shelves can be coupled directly to the posts of the frame. Electrical and/or data connections can be provided via a horizonal rail incorporated in the skin. The rails can include a plug-in module and wire management channels extending outwardly from the module. The wall system may incorporate a pocket door built on the same principle as the overall wall structure. Also disclosed are a pivot door structure and a patch plate for fitting a standard lockset or latchset to a glass door.

13 Claims, 30 Drawing Sheets

28
40
62
47
40
36
64
56
28
47
56
74
72
28
72
70
70
74
42
58
36
64
58
42
27

56
60''
80
B
60'
58

82
84

84b
84a

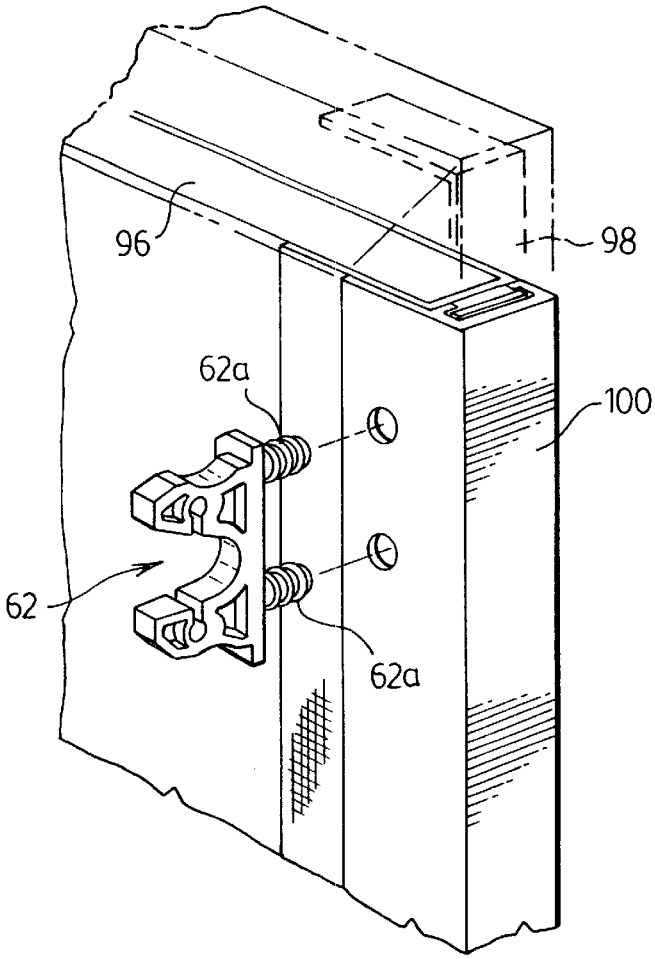
FIG. 7.
FIG. 8.
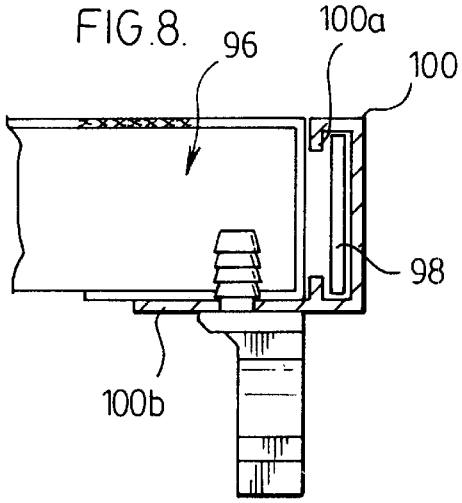
FIG. 9.
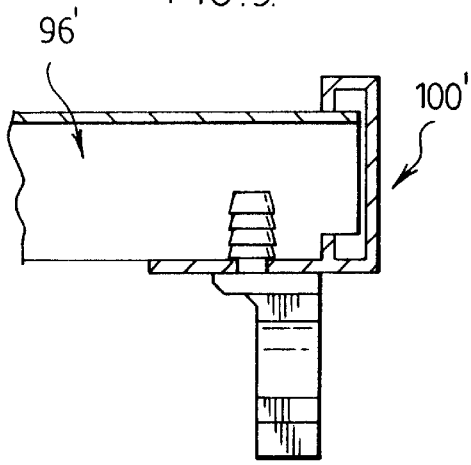

FIG.18c
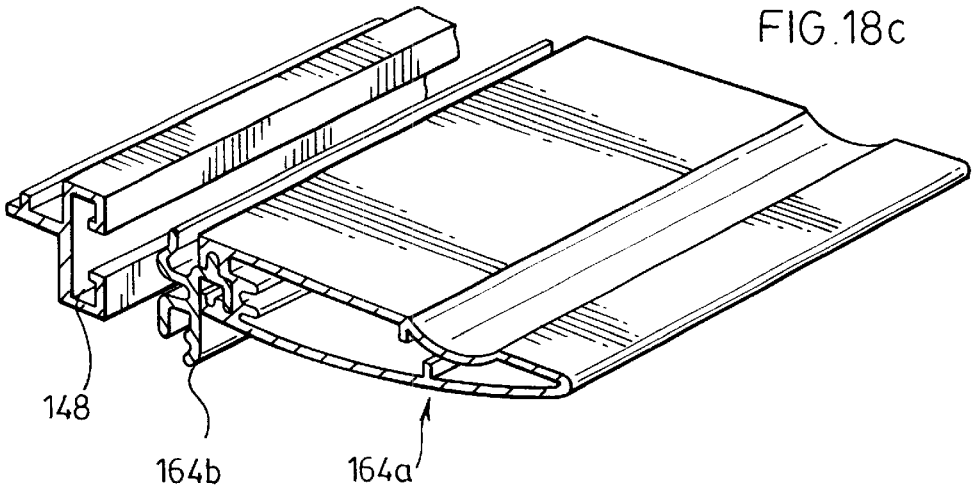
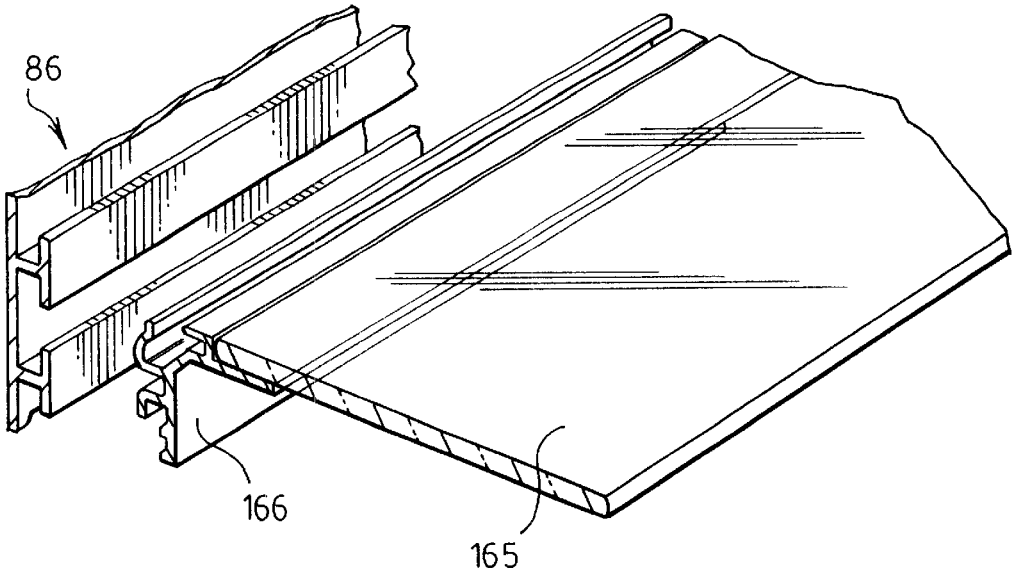
FIG.18d.

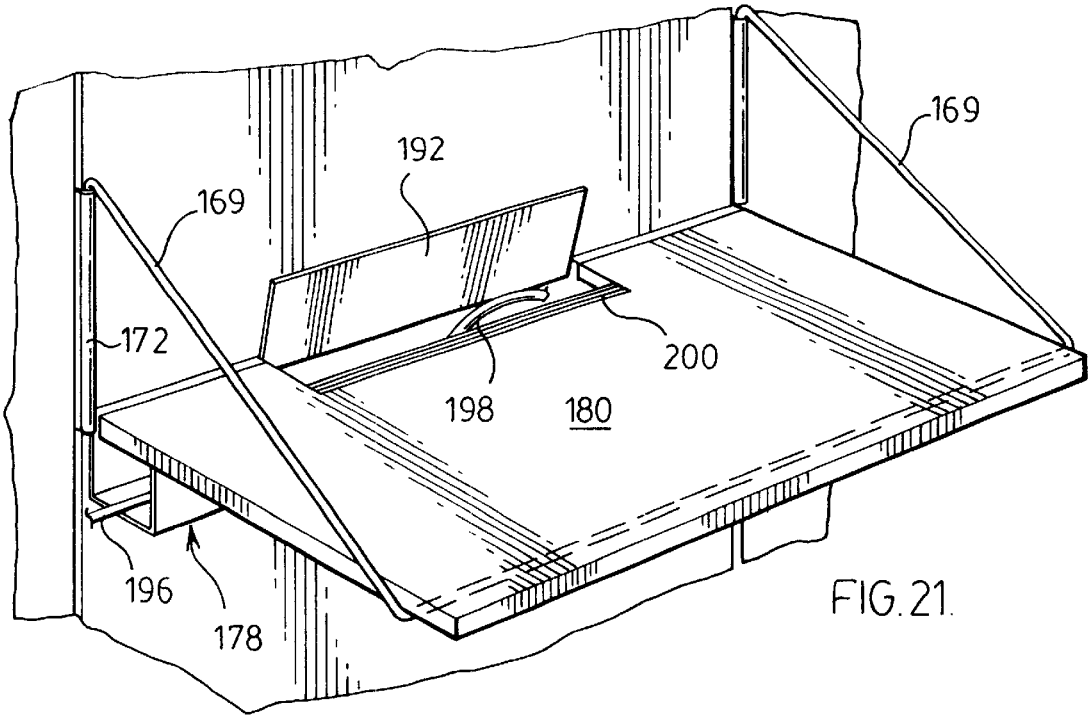
FIG. 21.
FIG. 22.
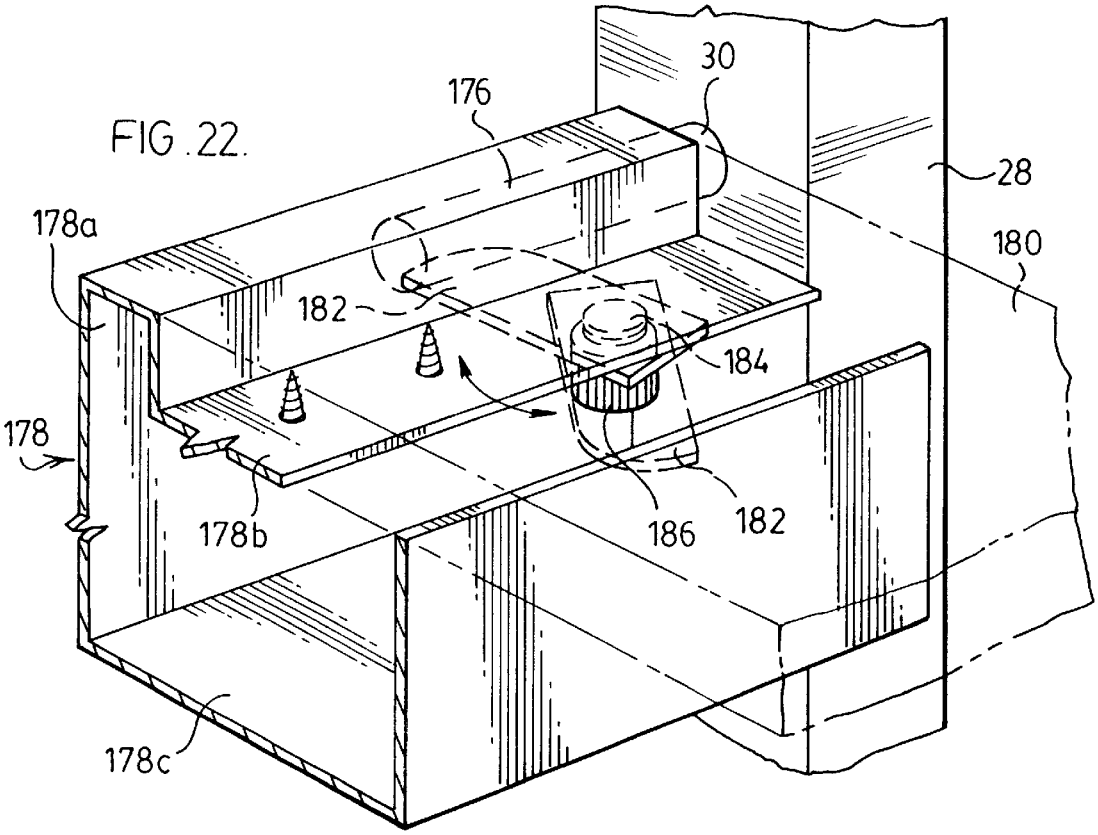

280
282

286
266
294
278
284
288
292
290
276
258
270
272
274
268

WALL SYSTEM

CROSS-REFERENCE TO RELATED APPLICATIONS

This application claims benefit from U.S. provisional application Serial No. 60/137,503 filed Jun. 4, 1999 which is incorporated herein by reference in its entirety.

FIELD OF THE INVENTION

This invention relates generally to interior wall systems for buildings.

BACKGROUND OF THE INVENTION

As constructed, a modern office building typically has a central core for elevators and other services, surrounded by a largely open floor area that extends to the perimeter of the building. The occupant of a particular floor is responsible for finishing the open area according to its particular needs. Offices and other defined areas are constructed using partition walls that extend upwardly from the building floor to a finished ceiling that is added below the floor above. The partition walls can be built on site using conventional construction techniques, much in the manner of partition walls used in domestic housing construction. In other words, vertical studs (usually metal) are erected between the floor and the finished ceiling and are covered with wallboard panels that are secured to the studs using metal screws. The screw holes and joints between adjacent panels are filled and finished to give it smooth and flat wall surface that can then be painted.

An alternative is to use partition wall systems that are prefabricated elsewhere and then erected on site. Numerous wall systems of this type have been proposed and are reflected in the patent literature. Some examples can be found in the following United States patents:

U.S. Pat. No. 4,208,850 (Collier)

U.S. Pat. No. 4,395,856 (Smith et al.)

U.S. Pat. No. 4,437,280 (Collier)

U.S. Pat. No. 4,833,848 (Guerin)

U.S. Pat. No. 5,364,311 (Chou)

U.S. Pat. No. 5,377,461 (DeGrada et al.)

U.S. Pat. No. 5,433,046 (MacQuarrie et al.)

One approach reflected in the prior art is to supply prefabricated wall panels (e.g. 4 feet×8 feet in overall size) that are delivered to the site in substantially unitized (finished) condition. The panels are installed between floor and ceiling tracks that have previously been fixed in place. The panels are butted together side-by-side, and trim is added, for example to provide doorways or other features.

U.S. Pat. No. 5,159,793 (Deugo et al.) shows an example of a system that employs prefabricated panels.

A somewhat different approach that allows for more "customized" design of the individual offices, involves erection on site of an internal wall framework to which prefabricated wall fascias are fitted to provide a finished wall structure. The fascias can be made in a variety of different modular sizes and styles to allow wide flexibility in office design. For example, transparent (glazed) fascias can be provided to make a "glass" wall. The present invention provides improvements in the wall system of this type. An example of such a wall system has been available for a number of years from Iterby Italiana Mobili SRL of Pesaro, Italy.

SUMMARY OF THE INVENTION

The invention provides a wall system for partitioning interior space within a building, comprising an internal frame having upright posts and transverse rails extending between the posts, and a plurality of panels secured to the frame and forming an external wall covering on the frame. The wall system includes at least one of the features described below:

Specially designed wall fascia elements ("smart elements") may be located wherever appropriate in a wall and may provide special wall surface features such as a whiteboard writing surface, a tackable pin-up surface or an accessory-type element for example having lateral channels into which accessories can be hooked. These special elements are visually integrated and lie flush with the "regular" fascias of the wall system. The smart elements are made available in modular sizes to match the sizes (e.g. widths) of other fascia elements of the wall system.

An accessory rail that extends horizontally of the wall system may be integrated as part of a smart element, or provided separately. The accessory rail will provide one or more horizontal, undercut channels into which can be hooked accessories such as shelves or the like.

A range of different shelf structures may be provided to work in association with such an accessory rail.

Another feature is the provision of power data and voice communication plug-in connections as part of the wall system. The wall system can accommodate face-mounted plug-ins and/or a movable power/data module that can include a facility to "lay in" wire horizontally along the wall, as a wire management feature.

Further features relate to the provision of shelves that include shelf supports designed to be engaged respectively with two adjacent main wall posts of the wall system so that the shelf itself can extend between the supports, allowing relatively heavy weights to be supported directly from the main wall frame. The shelf can include a so-called "technology shelf" capable of supporting computers, monitors or other technology-related components.

Still further features relate to a pocket door and a pivot door that can be incorporated into the wall system of the invention.

Other types of doors also are possible, of course, including a glass door that includes an adaptor permitting a standard lockset to be used.

BRIEF DESCRIPTION OF DRAWINGS

In order that the invention may be more clearly understood, reference will now be made to the accompanying drawings which illustrate various aspects of the invention, and in which:

FIG. 4(*a*) is a sectional view through one of the horizontal rails of the wall system where glazed fascias are used;

FIGS. 7, 8 and 9 are detail views illustrating the structure of a typical smart skin element;

FIGS. 20, 21 and 22 are perspective views showing details of a typical technology shelf;

DETAILED DESCRIPTION OF DRAWINGS

Figure 1:
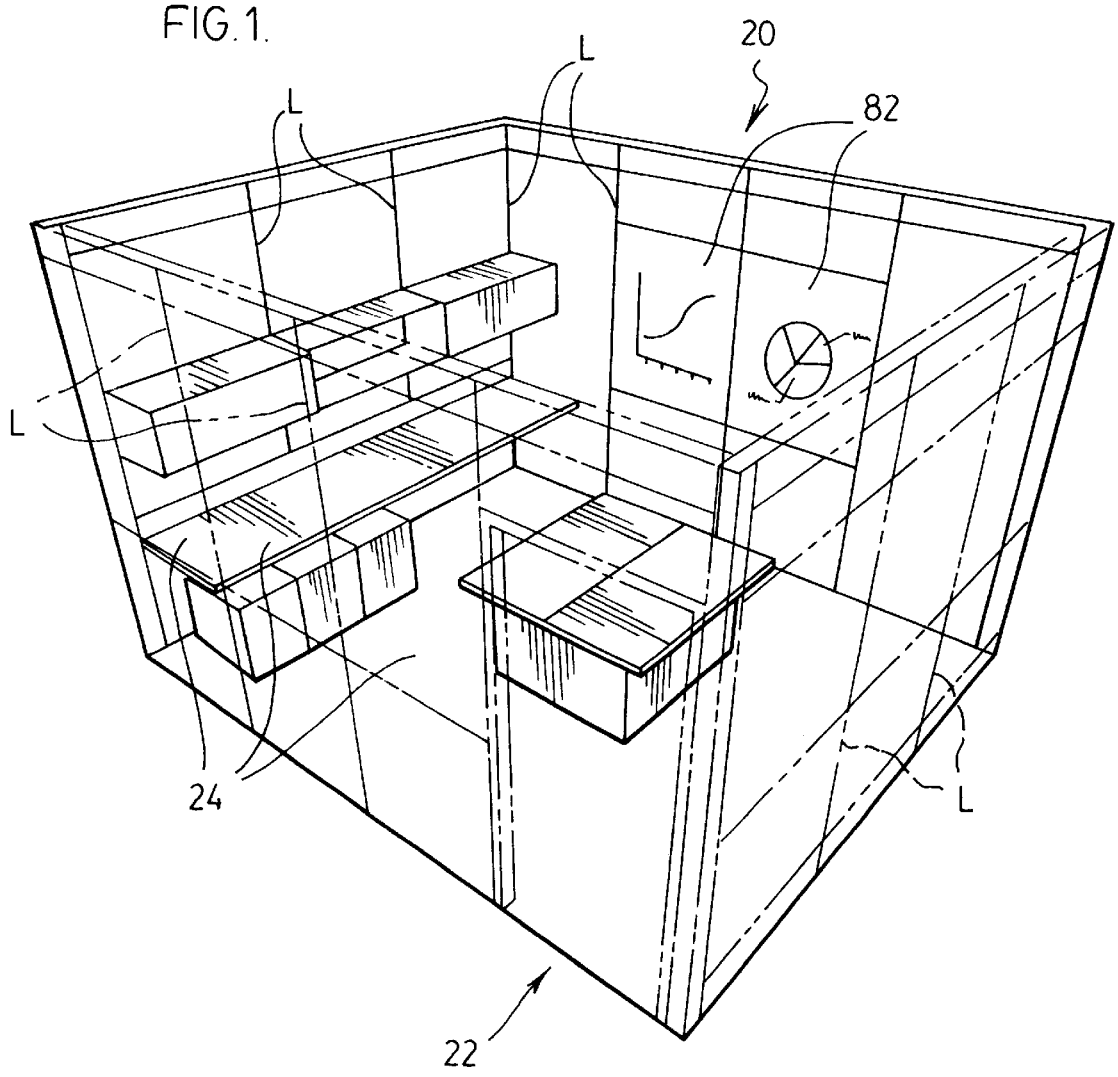
FIG. 1 is an overall perspective view showing generally an office structure constructed using the wall system of the present invention.

Referring first to FIG. 1, an office structure constructed using the wall system of the invention is generally indicated by reference numeral 20. As can be seen, the structure is generally rectangular overall with a door 22 at one corner. The rectangular structure of the office is defined by an internal wall frame constructed using the components shown in FIG. 2. Rectangular fascia panels are then secured to the frame to provide the wall surfaces of the offices. The fascia panels are modular and are made in a number of different sizes so that different panel arrangements can be used depending on the features required in the office. Typical module widths are represented by the vertical lines L.

Generally speaking, the frame includes vertical posts (to be described) that are spaced laterally from one another on defined "centres". The fascia panels used between adjacent pairs of posts are dimensioned to match the spacing between the posts so that the finished wall has the appearance of a series of adjacent vertical rectangular surface areas. Typically, each such area is divided into at least three sections comprising narrow top and bottom fascia panels and at least one main panel between the top and bottom fascia panels. In this way, defined "lines" between the panels extend horizontally of the wall structure, for aesthetic effect. In certain styles of wall, a so-called "belt line" may be defined at desk height, and another at a defined height above the finished floor (e.g. 81").

Some of the wall sections can be finished using glazed fascia panels, for example as indicated at 24 in FIG. 1, so that the office has a glass wall.

FIG. 1 also shows various desk, shelf and cabinet structures that can be suspended from the wall system of the invention.

Figure 2:
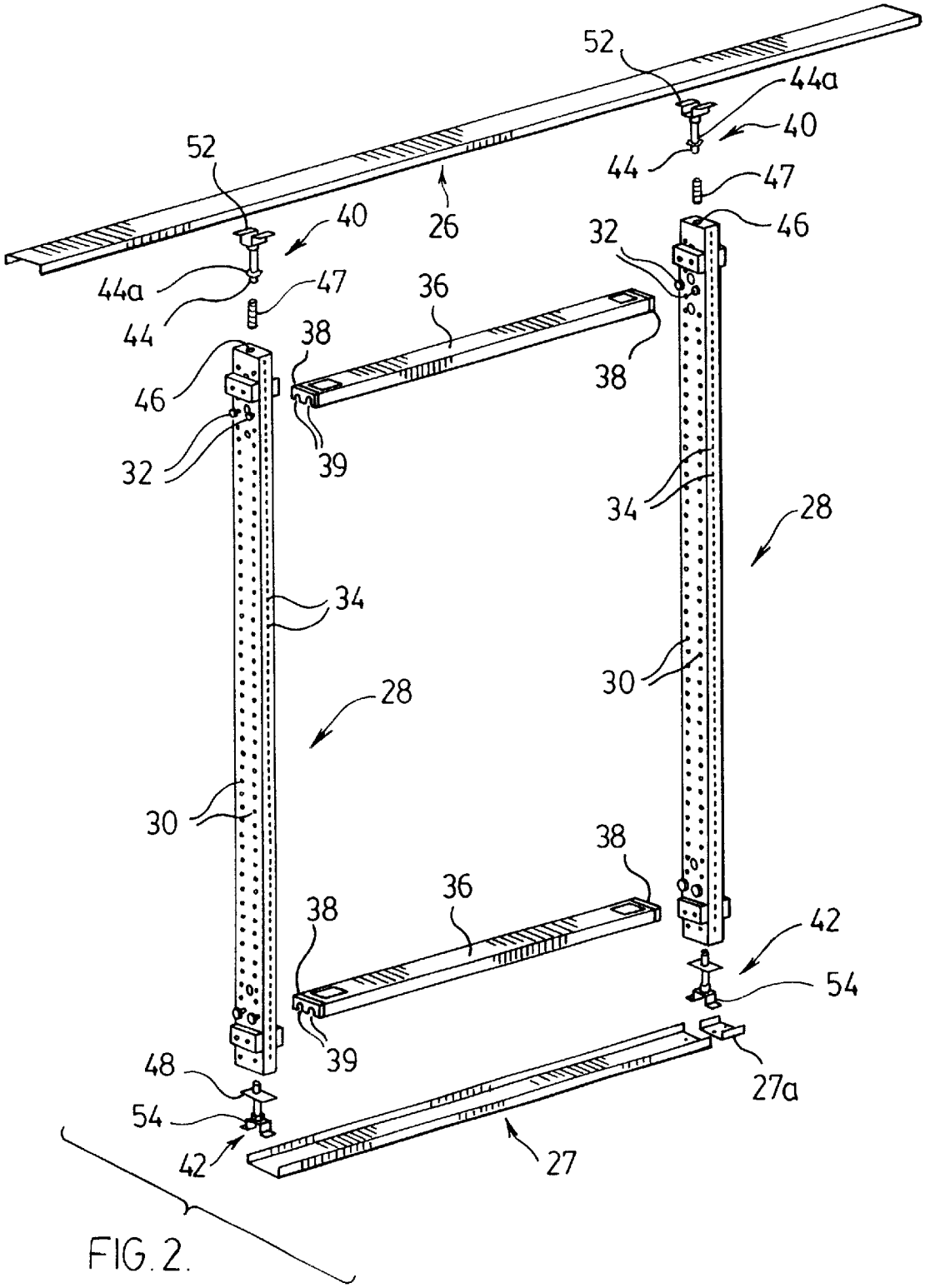
FIG. 2 is an exploded perspective view showing the internal wall frame of the wall system.

The principal components that are used to assemble the internal frame of the wall system are shown in FIG. 2. In constructing a wall, the line that the wall is to follow is first established on the finished ceiling and a corresponding line is then established on the floor in vertical alignment with the ceiling line. A ceiling channel 26 is then secured in place. Generally speaking, the ceiling channel 26 will be a continuous channel. A corresponding floor channel indicated at 27 is modular and is installed in sections (using connecting clips 27*a*) to match the modular spacing between adjacent vertical posts of the wall frame. This allows one section of the floor channel to be removed to allow a section of the wall to be removed, e.g. to facilitate changes in office design after initial installation. The floor channel may, but need not be secured to the floor.

Two adjacent vertical posts of the wall frame are indicated at 28 in FIG. 2. It will be seen that each post is a box section metal fabrication having a pair of wide faces and a pair of narrow faces and positioned with the wide faces transverse to the channels 26, 27. Each of the wide faces of each post is provided with two series of openings 30 that are spaced transversely of the face with the openings in each series horizontally aligned with one another. These openings allow bolts such as a pair of connector bolts indicated at 32 to be secured to the post in a plurality of positions spaced along the post. The narrower faces of each post are each provided with a series of vertically elongate slots 34.

The connector bolts 32 have enlarged heads and are designed so that horizontal rails such as the rails indicated at 36 can be connected between adjacent posts 28. The rails 36 are also box-section metal fabrications. Inserted into each end of each rail is a plastic rail joining bracket 38 that has a pair of downwardly opening slots 39 for engagement over a pair of connector bolts 32. The slots are designed to snap over the heads of connector bolts 32 and be frictionally retained on the bolts. The brackets 38 fit snugly against the respective vertical posts 28 so as to form a rigid connection between the rail and post. It will be appreciated that this coupling arrangement allows for horizontal rails to be positioned at almost any desired location between an adjacent pair of vertical posts.

Each vertical post is located with respect to the ceiling and floor channels 26 and 27 by top and bottom levellers 40 and 42 respectively. Each leveller has a screw-threaded shank that is received in a sleeve in an end plate on the post. Referring to the top leveller 40 by way of example, its shank is indicated at 44 and a corresponding sleeve in a top end plate on the post is indicated at 46. A spring 47 is received in sleeve 46 and bears against shank 44 so that the leveller can be depressed to install the post. A nut 44a on shank 44 can then be tightened against the top of the post to lock the post in place. In the case of the bottom leveller 42, the corresponding end plate (48) at the bottom of the post is separate from the post itself and is supported on the shank (49) of the leveller by a nut 50 that can be adjusted up and down on the shank to adjust the vertical position of the post. The shanks of the respective levellers carry corresponding channel members 52 and 54 respectively that have outwardly turned flanges for snug engagement within the respectively ceiling and floor channels 26,27.

In building a wall, a first vertical post 28 is positioned with its levellers 40 and 42 engaged with the respective ceiling and floor channels and the two levellers are adjusted against the respective channels so as to appropriately position the post in the vertical direction. At the same time, the post is positioned precisely vertically in the longitudinal direction of the channels. Lateral vertical location is of course assured by proper positioning of the channels themselves. As noted previously, the top leveller 40 is spring-loaded so that it can be temporarily positioned against the top channel 26 while the post is positioned.

A second vertical post is then similarly positioned at a precise lateral spacing from the first post appropriate to the required modular width of a section of the wall system, defined by a horizontal rail 36. Rails 36 are engaged with connecter bolts 32 on the respective posts 28 as described previously. This positions the two posts precisely vertically with respect to one another. Additional horizontal rails 36 can be added as appropriate according to the configuration of fascia panels or skins to be secured to the vertical posts. Construction then proceeds by adding additional vertical posts and horizontal rails in the same fashion. The spacing between successive vertical posts 28 may vary according to aesthetic considerations, office size and/or the need to accommodate features such as doors or glazed sections in the wall.

Figure 3:
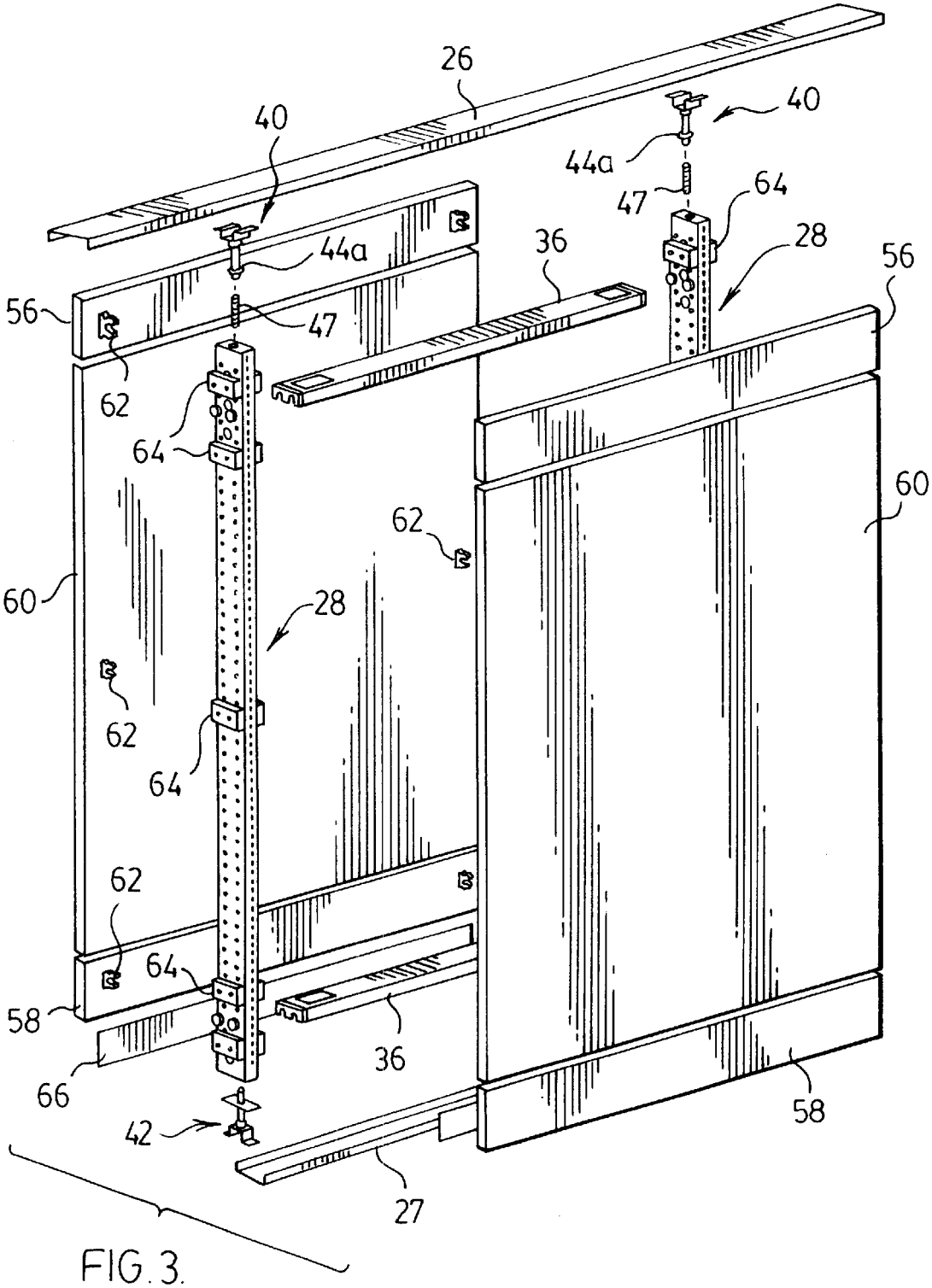
FIG. 3 is a view similar to FIG. 2 showing fascia panels to be added to the frame of FIG. 2.

FIG. 3 shows the same frame components as FIG. 2 but in association with fascia panels that are to form the finished surface of the wall. As shown in FIG. 3, the inner and outer surfaces of the section of the wall between the two adjacent vertical posts are to be finished in the same fashion, although that is not always the case. Three fascia panels or elements are provided at each side, namely a narrow top fascia 56, a corresponding bottom fascia 58 and a large rectangular fascia 60 between the top and bottom elements. This represents a so-called "full" wall module. Often, several panels of smaller height will be used in place of the single central panel 60. Typically, a bottom panel would extend to a "belt line" 36 inches from the finished floor, a panel above that panel would extend to 81 inches above the finished floor, and then a smaller top panel would be provided below the top fascia panel 56. Where necessary, the vertical height of this panel will respond to the floor to ceiling height, making up the difference. Otherwise, the fascia panels will be made available in standard size and will be selected from "stock" according to design considerations in the particular office or wall being built.

The various fascia panels are secured to the vertical frame posts 28 by means of male "plug-in" connectors 62 that are secured to the inner surfaces of the fascia elements and engage in corresponding female connectors 64 that are secured by screws engaged in the holes 30 on the wide faces of the vertical posts. The male and female connectors 62, 64 are plastic mouldings and are designed to snap-fit together so that, once the connectors have been appropriately positioned on the fascia elements and posts respectively, the fascia elements can simply be lifted into place and "pushed" inwardly against the posts until the corresponding connectors snap together. Typically, the connectors are plastic mouldings and at least the male connectors can deform resiliently as they snap into place.

Connectors 62 and 64 are shown in detail in FIGS. 10(*a*) and (*b*), which will be described later.

Reference numeral 66 denotes a flat strip of gasket material that fits over the floor channel 27 and is located behind the bottom fascia element 58 to provide a finished appearance and an acoustical/visual barrier at the bottom of the wall section. For the same reason, a deflectable, curved gasket (not shown) may be provided along the top edge of the top fascia element 56.

Figure 4:
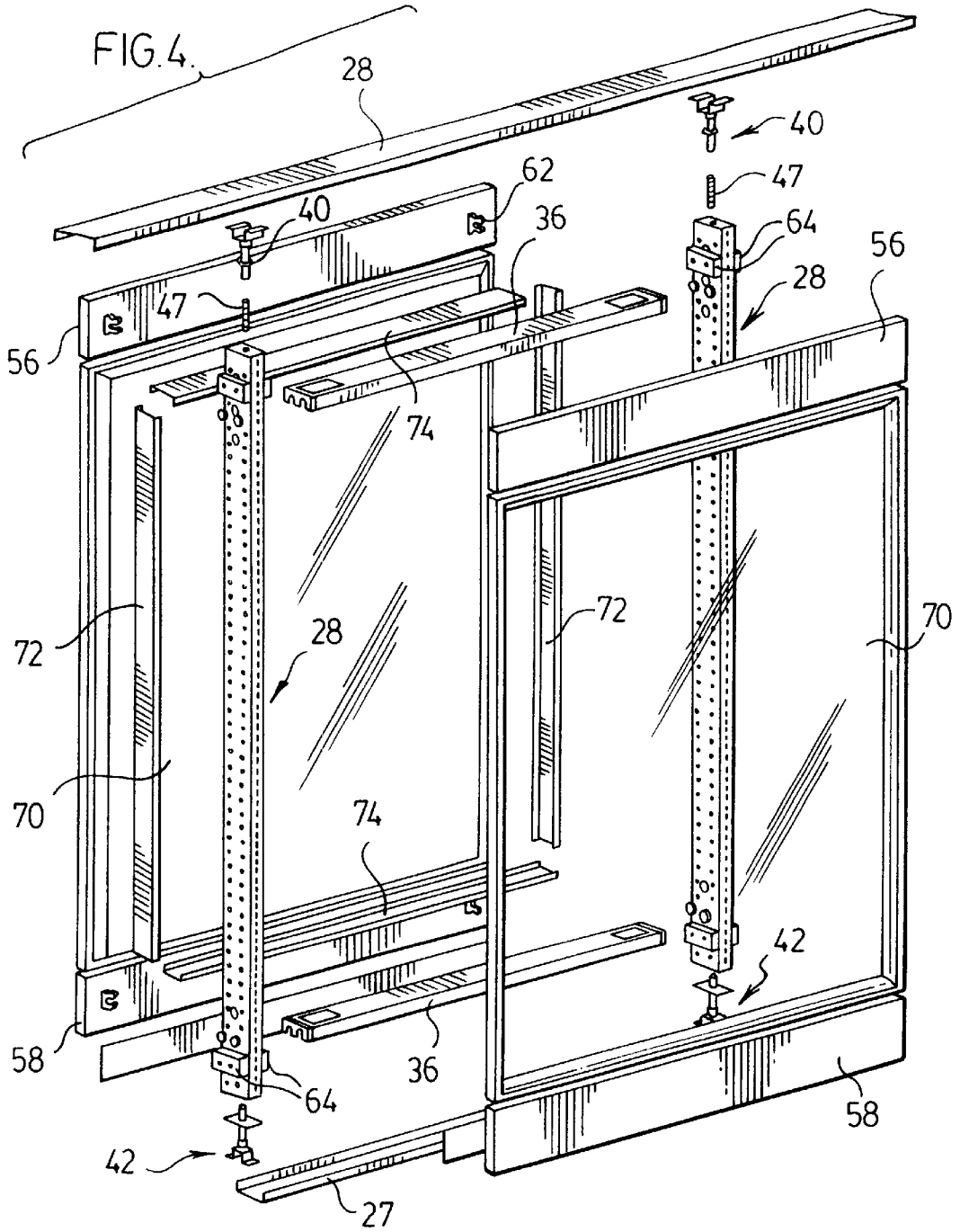
FIG. 4 is a view similar to FIG. 3 illustrating the use of glazed fascia panels.
Figure 4A:
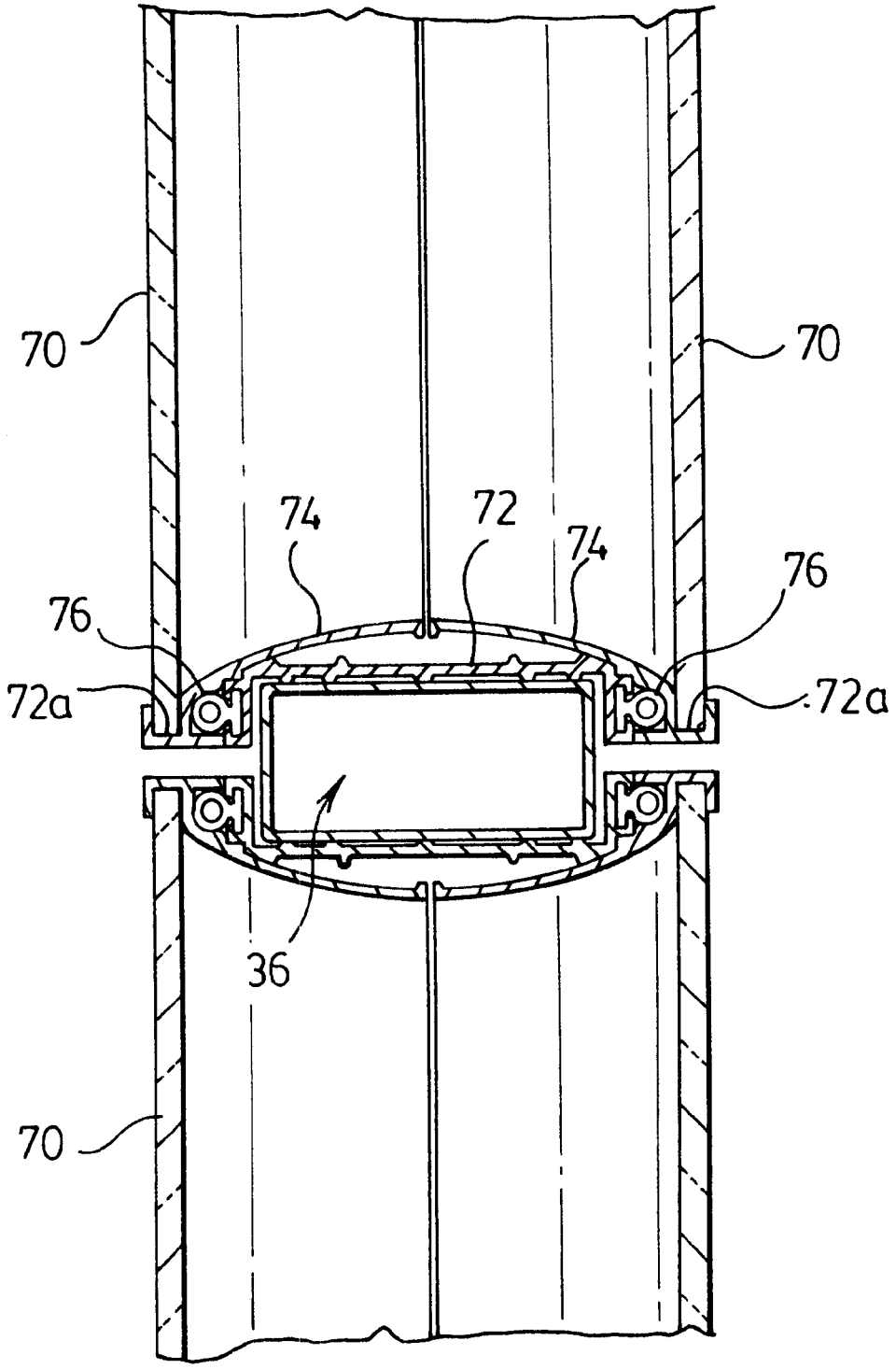

FIG. 4 is a view similar to FIG. 3, but in which the centre fascia panel 60 is replaced by a glass panel (sheet) 70 at both sides of the wall. Glass fascia panels may be made available in different sizes, for example, to make each of the glazed wall sections such as those shown at 24 in FIG. 1.

More than one glass panel may be used in a single section of wall; FIG. 4(*a*) is a vertical sectional view through a horizontal rail 36 between upper and lower glazed wall sections and is illustrative of the manner in which the glass sheets are retained on the frame of the wall system. Referring to the upper glazed wall section by way of example, an inner glaze trim element 72 comprising an aluminum extrusion is secured by screws (not shown) to the horizontal rail 36. The extrusion is shaped to define respective channels 72*a* at the outer sides of the extrusion that receive and locate the glass sheets 70.

Between the two glass sheets 70 are a pair of outer glaze trim elements 74 that meet on a vertical centreline of rail 36. The elements 74 provide an aesthetically pleasing surface finish between the two glass sheets 70. Outwardly of the rail 36, each of the trim elements 74 is clipped to the inner trim element 72 by a series of spaced glazed frame clips 76 that are designed to allow the glazed outer frame element 74 to snap into place on the glazed inner frame element 72. It will be seen that the elements 74 fit snugly against the inner surfaces of the glass sheets 70 and positively hold those sheets in place.

Glass sheets of the lower wall section are denoted 70 and are coupled to the rail 36 in the same fashion as sheets 70.

As can be seen from FIG. 4, rectangular sections of the inner and outer trim elements 72 and 74 are assembled in a rectangular configuration to form a complete "frame" assembly around and within each glazed unit of the wall system.

Figures 5A, 5B, 5C:
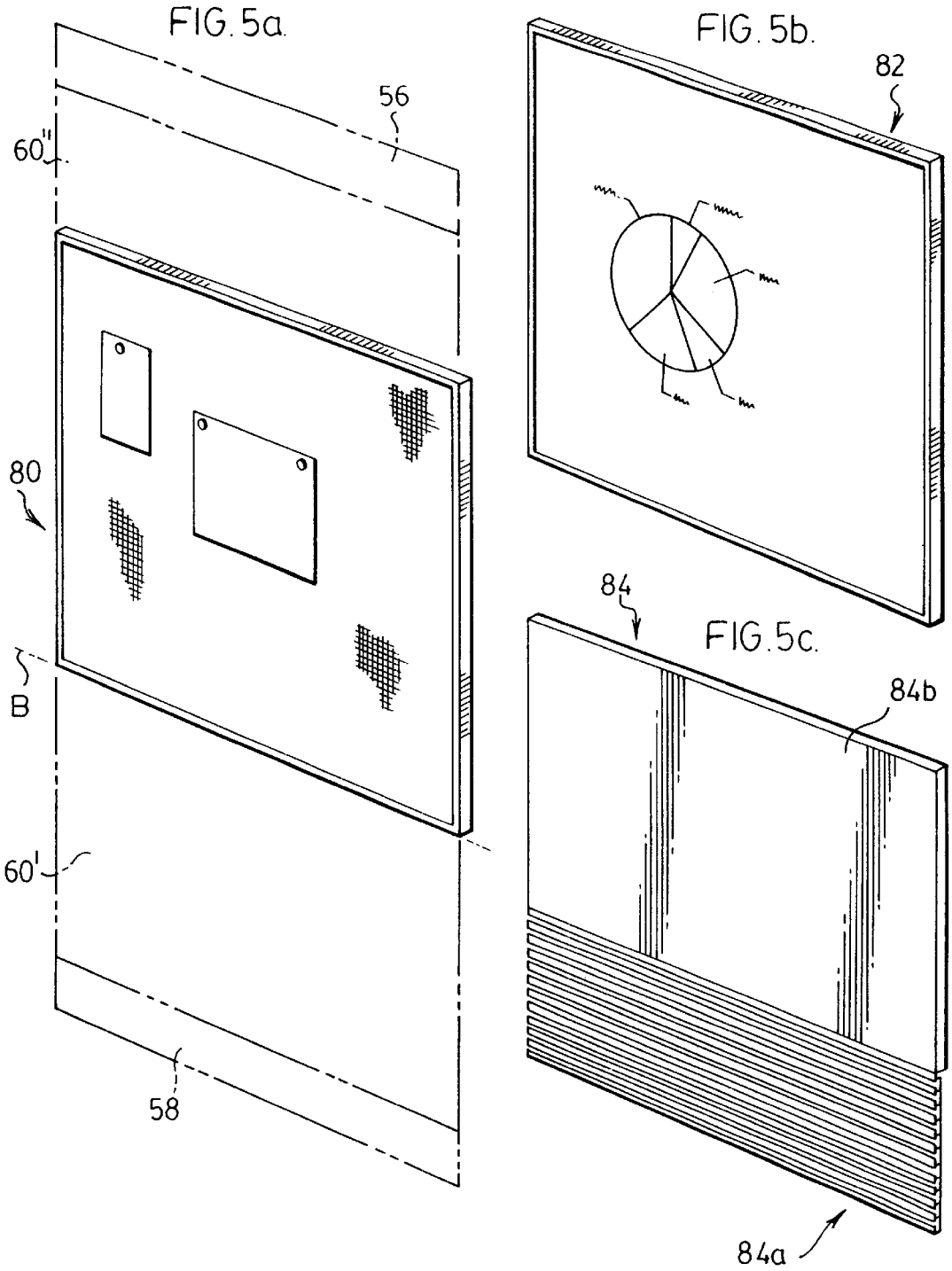
FIG. 5 comprises views denoted (*a*), (*b*) and (*c*) illustrating so-called "smart elements" that may be used with the frame of FIG. 2.

FIG. 5 illustrates alternative forms of so-called "smart element" fascias or panels that may be used at appropriate locations throughout a wall system. FIG. 5(*a*) shows a tack board 80, FIG. 5(*b*) a whiteboard 82, and FIG. 5(*c*) an accessory board 84. By way of example, two whiteboards 82 are shown directly adjacent one another in FIG. 1. Each element has a peripheral frame representing a design element, although that is not essential.

The ghost outline in FIG. 5(*a*) shows how any one of the smart skin fascias can be incorporated in a wall section with other "regular" fascias. Typically, a smart element will have a height of 45 inches and will be made available in different modular widths to match the modular widths of the wall sections of the system. As shown in FIG. 5(*a*), the bottom edge of tack board 80 is at the "belt line" B of the wall (typically 36 inches from the floor) and has below it a bottom fascia or valance 58, and an intermediate "regular" fascia 60'. Above fascia 80 is a top valance 56 and another "regular" fascia 60".

The various smart elements can be positioned wherever required in a wall, e.g. directly adjacent one another, in adjacent vertical wall sections.

Figure 6:
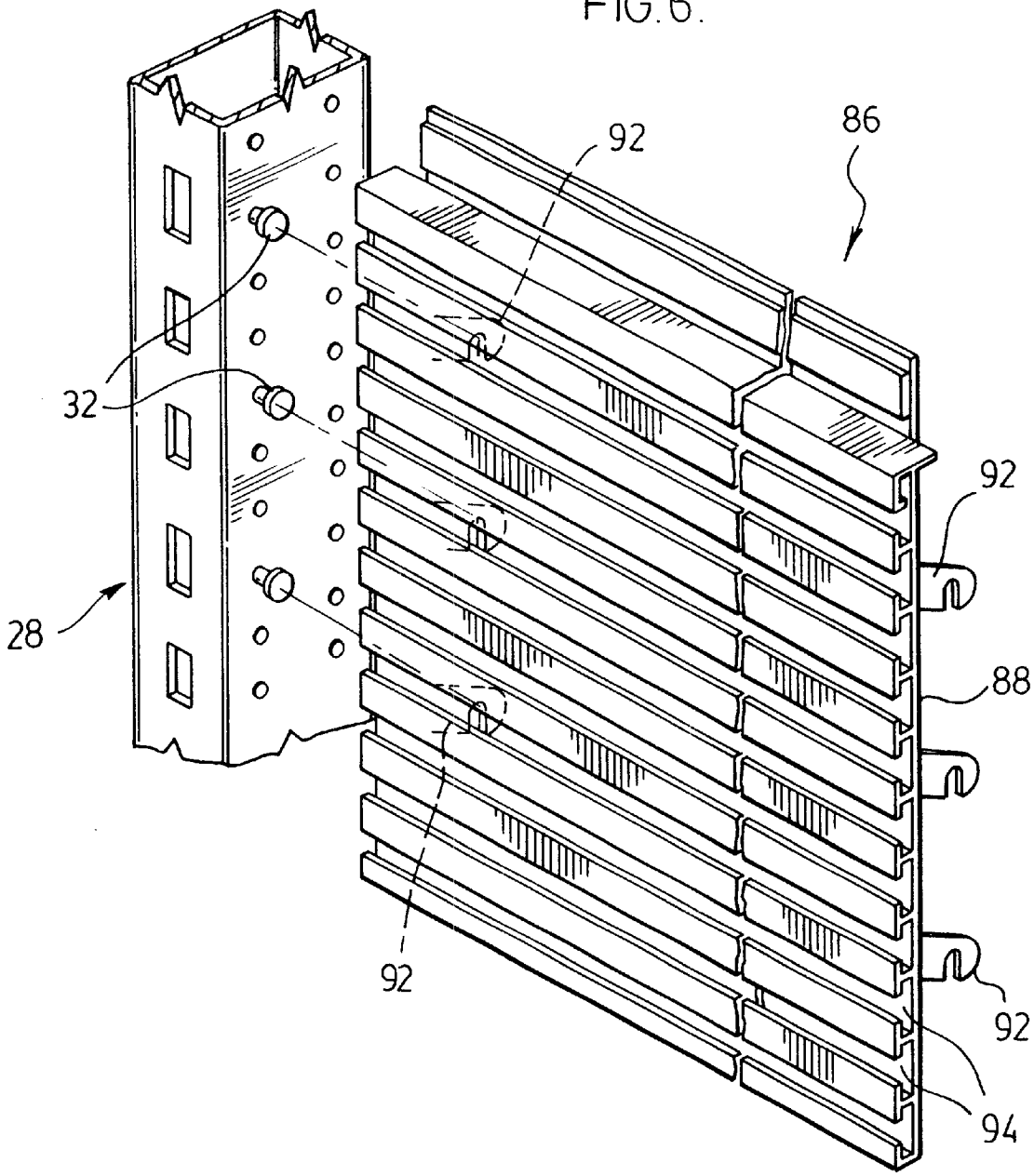
FIG. 6 is a perspective view illustrating an accessory element.

FIG. 6 shows an accessory element or rail 86 that can be used between a pair of adjacent vertical posts 28 of the wall structure. In the illustrated embodiment, the element 86 comprises an extrusion 88 (e.g. of aluminum). Respective pairs of hooks 92 extend rearwardly from the extrusion at opposite ends of the element and engage over bolts in the vertical posts 28 (e.g. the bolts 32 referred to previously). The front (outer) face of extrusion 88 is defined by a series of T-section ribs that run the length of the element and define between them a series of parallel undercut channels 94 into which various accessories can be hooked (see later).

Element 86 can be of any appropriate height. Typically the height will correspond to a panel of one of the wall section; however, element 86 may correspond in height to a portion only of a wall panel. For example, reverting to FIG. 5(*c*) the accessory board "smart element" 84 has a lower portion 84*a* that comprises an accessory rail 86. Above that portion, the "smart element" has a plain area 84*b* that can, for example, be a regular panel surface, a whiteboard or a tack board. The "smart element" 84 of FIG. 5(*c*) can have essentially the structure of FIG. 6 but with a plain panel continuing upwardly above extrusion 88. The plain panel could also be provided with hooks as hooks 92 for attachment to the posts 28.

Preferably, however, each of the smart skins shown in FIG. 5 has male connectors on its rear surface that are the same as the connectors 62 referred to in connection with FIG. 3 and that plug into female connectors 64 on the vertical posts, as shown in FIGS. 7 to 10.

The precise structure of the "smart elements" is not believed critical. As shown in FIG. 7, a possible structure for the tack board comprises a panel 96 comprising a honeycomb substrate with fibreglass on both sides, covered in a fabric that is wrapped around and secured to the rear of the panel using a hot-melt adhesive. Comer brackets are indicated at 98 for securing frame members 100 that carry the male connectors 62.

FIG. 8 shows the cross-sectional shape of one of the frame members 100. The member is an aluminum extrusion profiled to define a channel 100*a* for receiving limbs of the corner brackets 98. The extrusion is also profiled to define a limb 100*b* provided with openings to receive the male connectors 62. It can be seen that the connectors are essentially C-shaped plastic mouldings with projecting legs 62*a* that are ribbed so that the legs can be inserted through the openings in the extrusion and will grip, resisting withdrawal of the connectors.

FIG. 9 shows (in cross-section) a typical structure for the whiteboard 82. In this case, the panel (96') comprises particle board with a ceramic-coated steel plate face-mounted to the particle board. A peripheral frame extrusion 100' embraces the panel and trims the fascia off providing the same aesthetic appearance as the smart fascias.

Figure 10A:
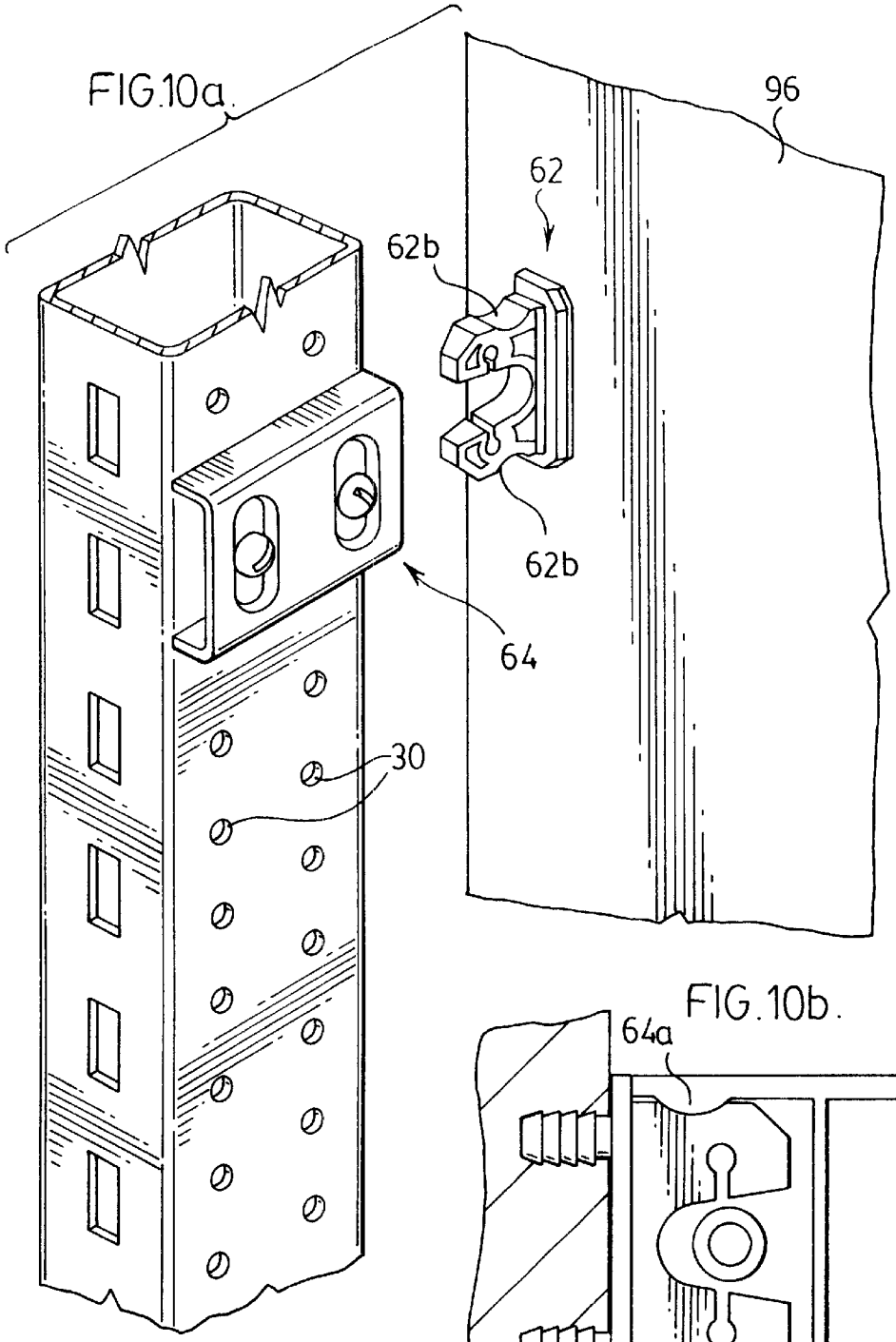
FIG. 10 (*a*) and (*b*) are an exploded perspective view and an assembled sectional view respectively illustrating the method of coupling a smart skin element to a vertical post of the wall system.
Figure 10B:
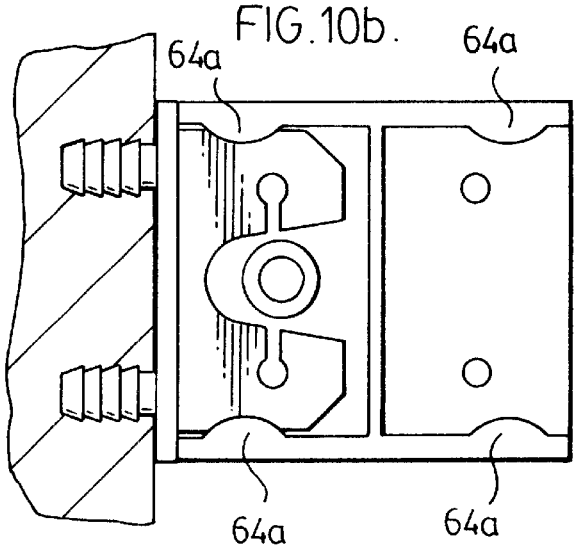

FIGS. 10(*a*) and (*b*) show one of the male connectors 62 mounted on a typical one of the panels 96, in association with one of the female connectors 64. As can be seen, the female connector 64 is essentially a channel-shaped element held by screws that are threaded into a pair of the openings 30 in a vertical post 28 of the wall system.

FIG. 10(*b*) shows the internal profile shape of the female element 64 and the fact that it is symmetrical at opposite ends and profiled internally to define respective inward protrusions 64*a* that match corresponding recesses 62*b* on the male element 62 so that the male element snaps into and is positively located with respect to the female element 64.

Figure 11A:
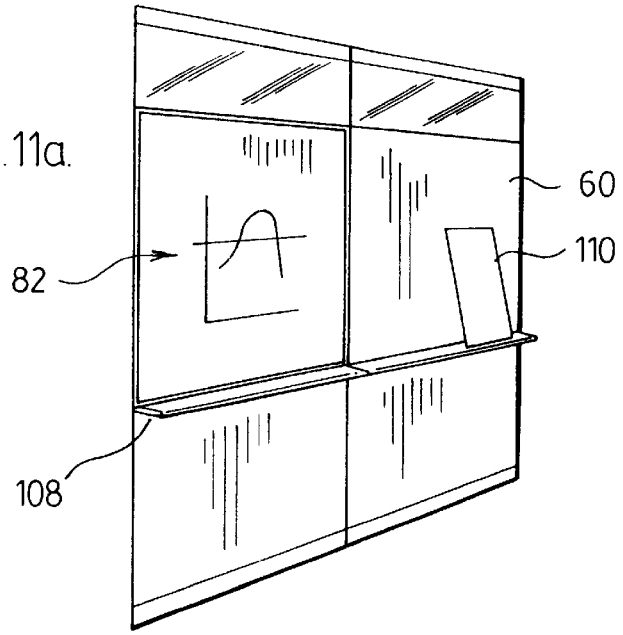
FIG. 11 comprises views denoted (*a*), (*b*) and (*c*) illustrating possible applications of narrow shelves (e.g. 3 ½" or 6" wide)
Figure 11C:
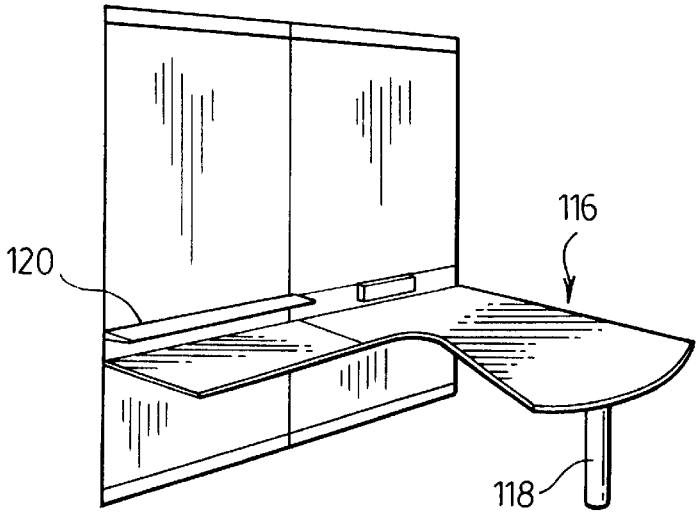
Figure 11B:
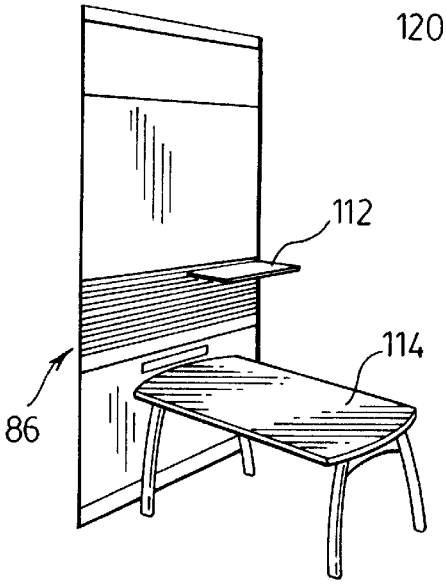

FIG. 11 illustrates some of the possible applications of the smart skin element of FIG. 5(*c*), or the accessory rail of FIG. 7 in combination with a plain fascia or in combination with a tack board or whiteboard smart fascia (element).

FIG. 11(*a*) shows two adjacent wall sections in which a small accessory shelf 108 has been positioned at the "belt line" of the wall sections, below a whiteboard fascia 82 in one section, and below a regular fascia 60 in the adjacent section. The shelf serves as a support for small objects (such as markers/brushes for the whiteboard) or, for example, an auxiliary display 110.

FIG. 11(*b*) shows an accessory rail 86 used to support a small, short shelf 112 above a free standing table 114.

FIG. 11(*c*) shows a typical L-shaped work surface 116 that extends across two wall sections and is supported by cantilever brackets (not shown) that engage the vertical posts of the wall frame. An overhanging return of the work top is supported by a separate leg 118. Above a portion of the worktop, a short shelf 120 extends across the width of only one of the wall sections by way of an accessory rail, part of the lay-in rail and plug-in module.

Figure 18A:
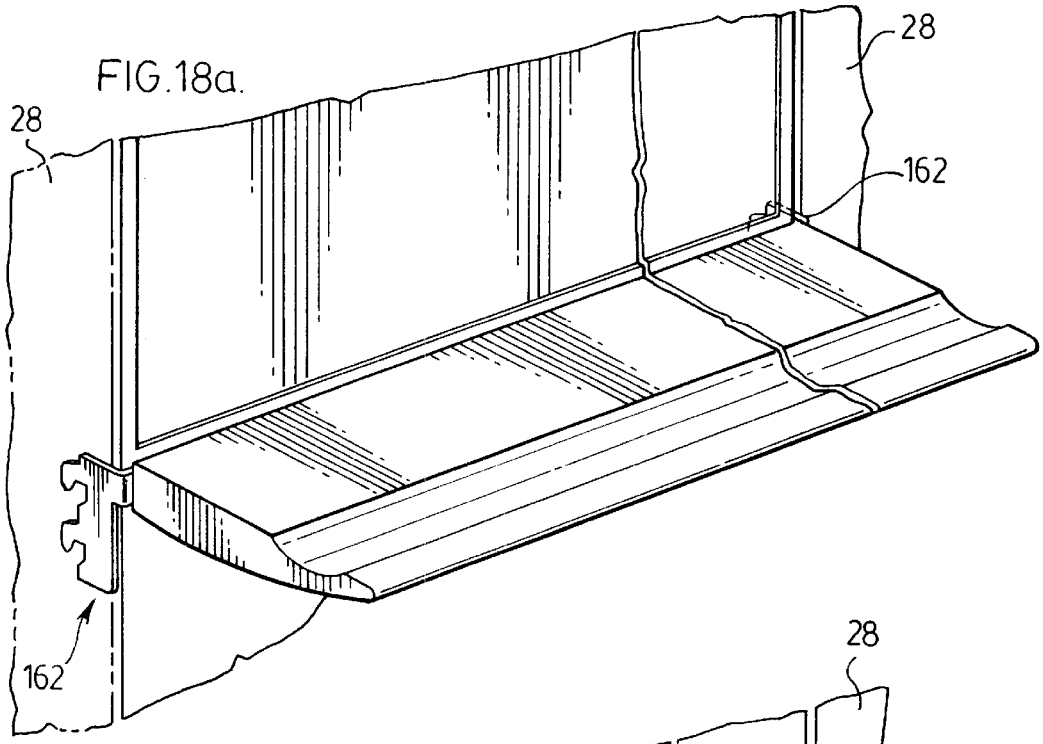
FIG. 18 comprises views denoted (*a*), (*b*), (*c*) (*d*) and (*e*) illustrating alternative accessory shelves and combinations of shelf types for supporting small objects on the wall system of the invention.
Figure 18B:
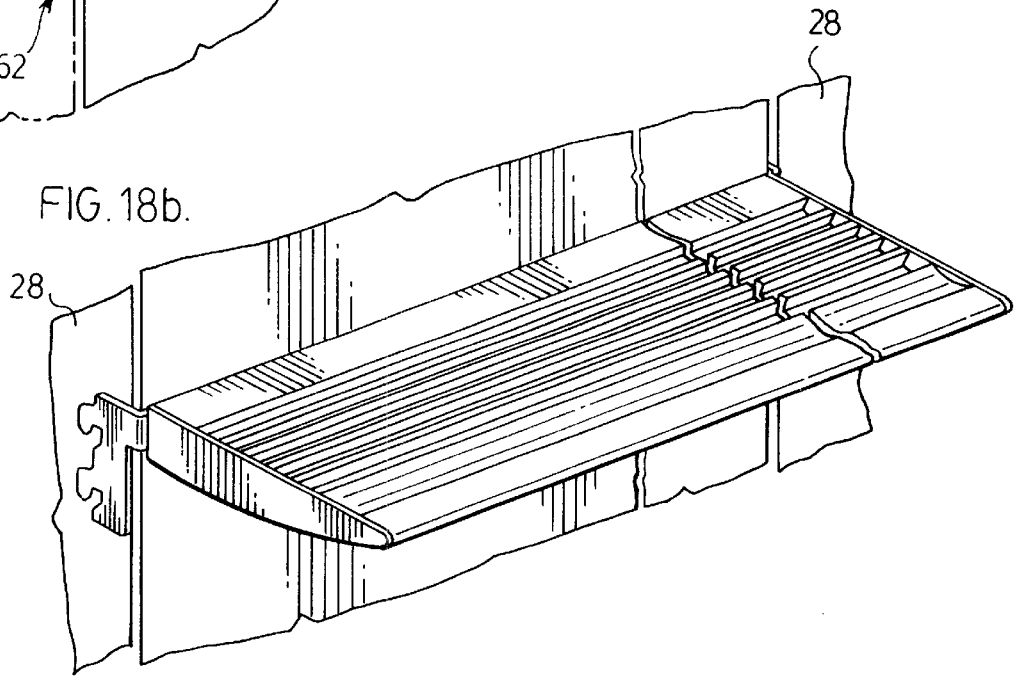

The shelves shown in FIG. 11 may be of the types shown in FIG. 18 (to be described). The lengths of the shelves can be independent of the widths of the fascias ("off module"), since they are hung on the accessary rails and not into the vertical slots in the vertical ports.

Figure 12A:
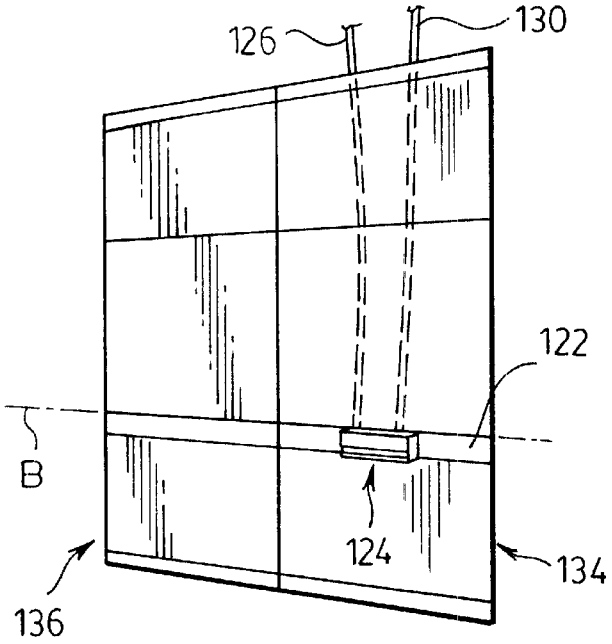
FIG. 12 comprises perspective views (*a*) and (*b*) which illustrate alternative power, data and voice communication plug-in and wire management features of the invention.

FIGS. 12 to 17 illustrate various aspects of the invention that deal with the issue of providing power and data plug-in facilities in a wall system. As seen in FIG. 12(*a*), two adjacent wall sections are shown, with a "lay in" power/data rail 122 at the belt line B. The rail 122 extends over the width of two wall sections and has the general configuration shown in FIGS. 13 to 17 (to be described). Rail 122 incorporates a plug-in module 124 for power and data.

Figure 12B:
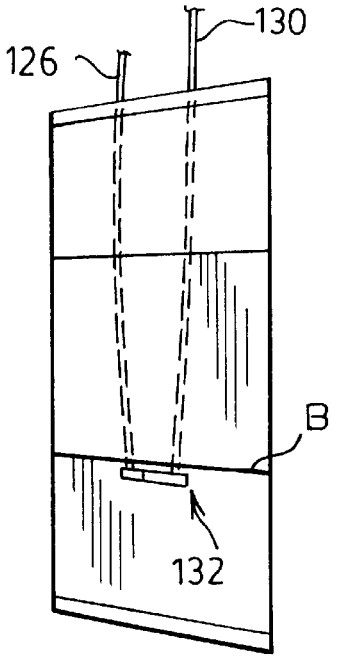
Figure 13:
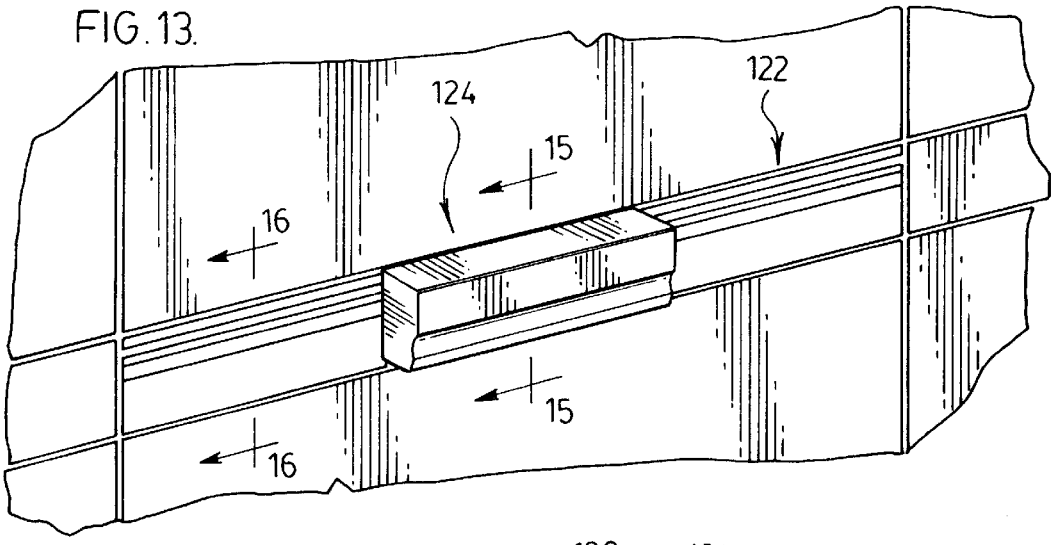
FIGS. 13 and 14 are perspective views illustrating the power and data module of FIG. 12(*a*)
Figure 14:
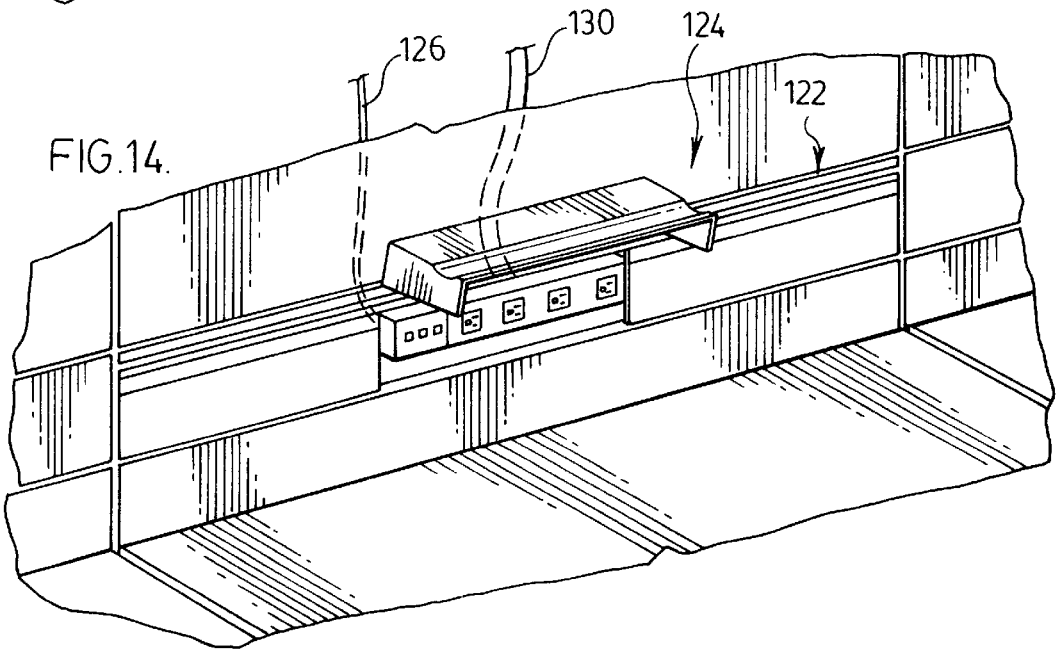

FIG. 12*b* shows an alternative face mounted plug-in panel.

In both cases, a section of wall is shown in which power lines 126 are connected from a ceiling supply (not shown) and extend down through the hollow space at the interior of wall to the plug-in point. Corresponding data connections are indicated at 130. As seen in FIG. 12(*b*), the connections 126 and 130 simply extend to a face-mounted plug-in module 132 in the lower fascia panel of the wall section at the belt line (B). Alternative locations for module 132 are in the bottommost fascia panel and a defined height above floor level (e.g. 18").

In the embodiment of FIG. 12(*a*), two alternatives are shown for the lower fascia panel of the wall section, namely a power and data plug-in fascia panel 134 and a lay-in panel 136. Panel 134 incorporates a rail 122 and a power and data module 124, in which portions of the accessory rail on opposite sides of the module 124 provide a concealed lay-in channel for wires or cables. In other words, wires or cables that are plugged into the module 124 can be laid into the rail 122 and routed elsewhere, for example, to an adjacent computer without the unsightliness of a tangle of visible wires. Panel 136 is the same but without the plug-in module 124; in other words, this panel simply acts as a conduit for longer runs of wires. It also allows accessories to be hung from the rail. It is of course possible to "mix and match" different fascia panels in adjacent wall sections according to requirements with respect to cabling, shelving or other considerations.

FIGS. 13 to 17 illustrate the "plug-in" module and the lay-in rail in somewhat more detail. The plug-in module 124 itself is shown respectively in closed and open positions in FIGS. 13 and 14. Connections 126 and 130 to power and data supplies respectively (FIG. 14) may incorporate conventional plug-in couplings (not shown). Also not shown are conventional plug-in jumper cables that can be used to extend power and data to adjacent modules.

Figure 16:
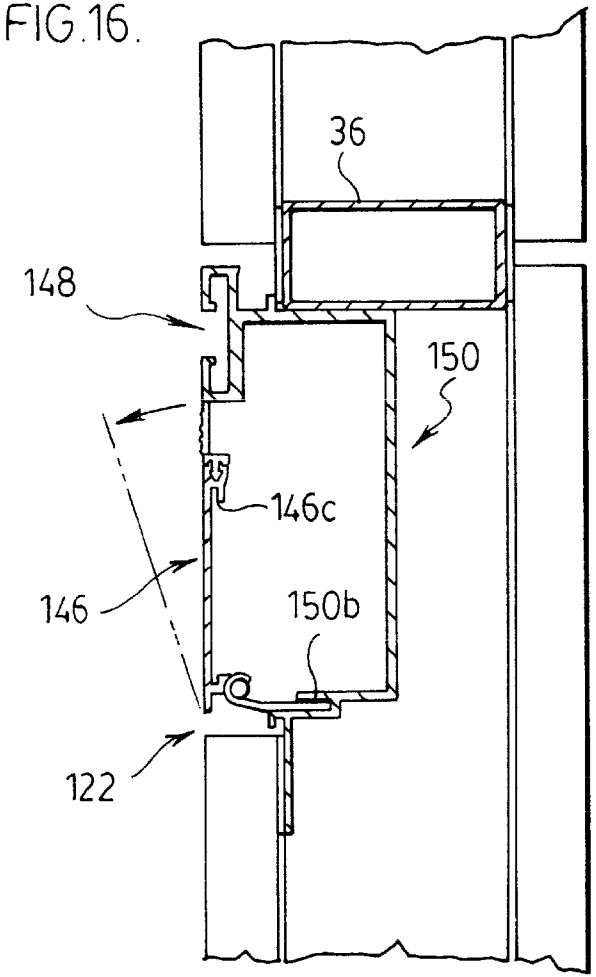
FIGS. 15 and 16 are vertical sectional views respectively on lines 15—15 and 16—16 of FIG. 13.
Figure 17:
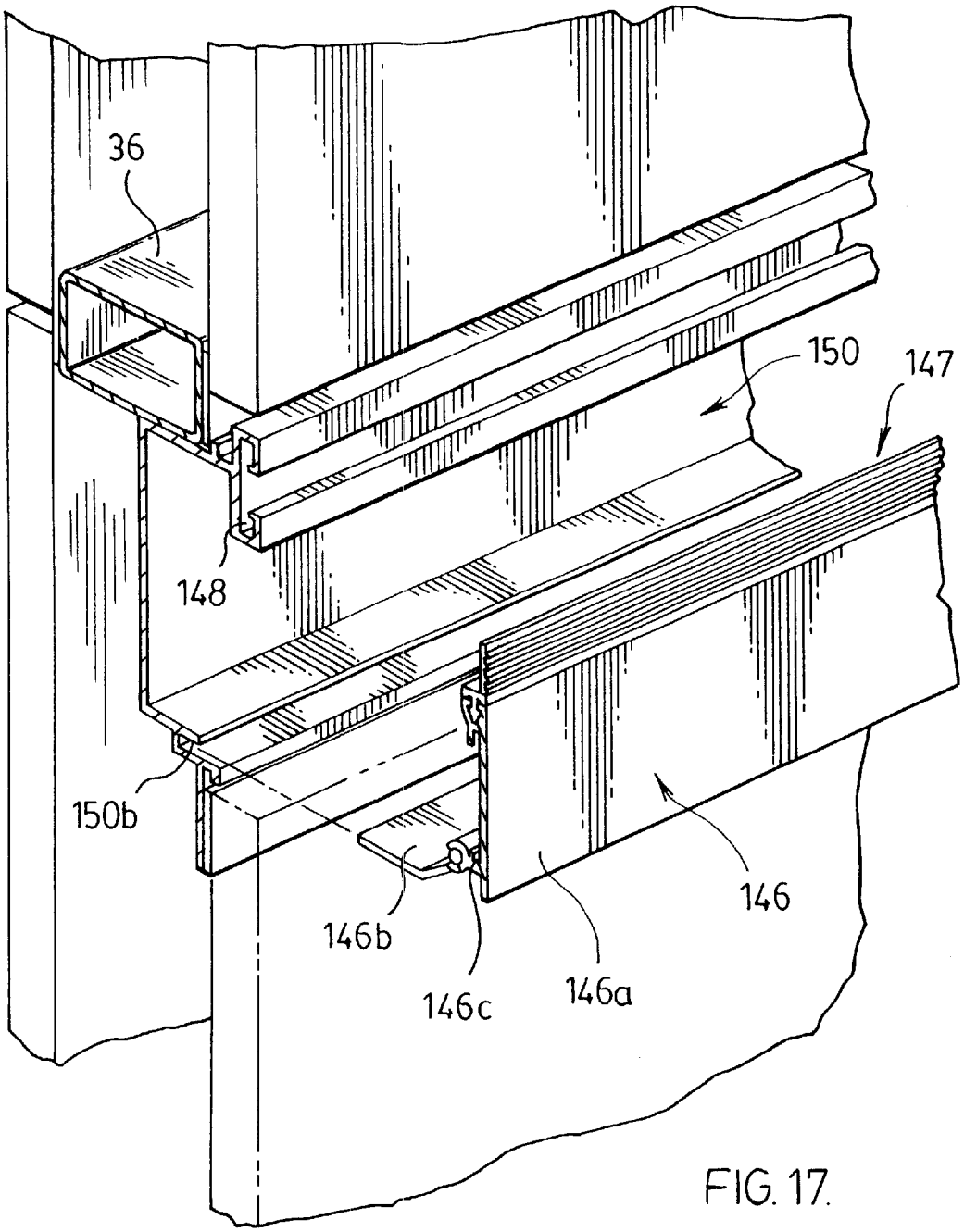
FIG. 17 is a partly exploded perspective view corresponding to FIG. 16.

FIGS. 16 and 17 show that both rails include a lower portion that has a removable cover 146 and provides a channel in which wires can be laid while remaining concealed. Directly above the cover 146 is an undercut groove 148 into which accessories such as shelves can be hung.

Figure 15:
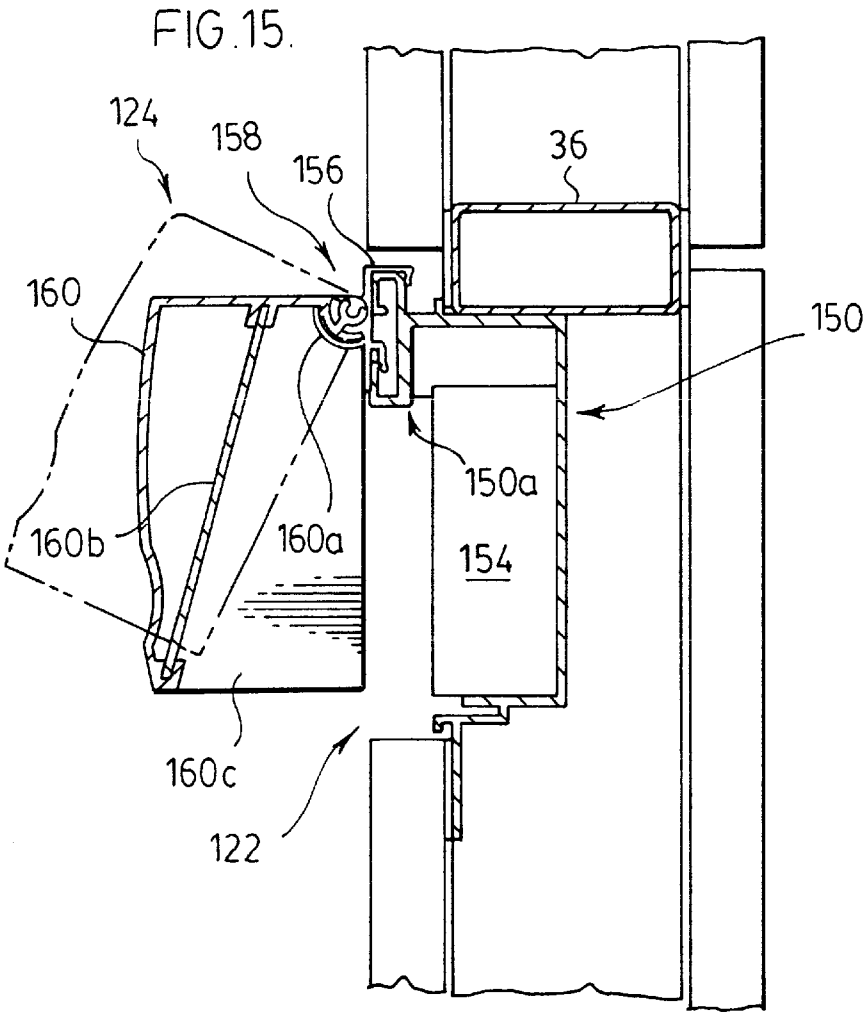

FIG. 15 is a vertical sectional view through the rail 122 at the position of the plug-in module 124 while FIG. 16 shows the cross sectional profile of the lay-in portion on opposite sides of module 124. The same profile is used for a lay-in rail that does not have a module 124.

It will be seen that rail 122 includes a base extrusion 150 that is generally channel-shaped and arranged with the channel facing outwardly of the wall. The extrusion is secured by metal fasteners (not shown) to the lower surface of a horizontal rail 36 of the wall frame. In the case of the plug in module 124, an electrical/data outlet box 154 is secured by screws (not shown) within the channel of extrusion 150.

A top portion 150*a* of extrusion 150 both defines groove 148 and, externally, is shaped to provide a support for an extrusion 156 forming part of a hinge 158 for a cover 160 that hangs down in front of and conceals the box 154. At the same time, the cover can be hinged upwardly as shown in ghost outline to provide more direct access to the box.

It will be seen that cover 160 itself comprises a first extrusion having an inner top portion 160*a* that co-operates with extrusion 156 to form hinge 158. The cover extrusion is also shaped to receive at each end a rib 160*b* on an end cap 160*c* for holding the end cap in place.

FIGS. 16 and 17 show that the base extrusion 150 of the rail also accommodates the cover 146. The cover itself comprises two extrusions 146*a* and 146*b*, the latter of which is shaped to slot into a groove 150*b* in extrusion 150 (see FIGS. 16 and 17). The two extrusions together define a hinge so that extrusion 146*a* can be pulled down to provide access to the interior of extrusion 150, e.g. for laying in or removing cables. At its upper edge, extrusion 146*a* is fitted with a flexible plastic lip 147 that co operates with the portion of extrusion 150 that defines groove 148, for normally retaining the cover in a closed upright position. Lip 147 can flex to accommodate wires led out of the rail. Apart from lip 147, the various extrusions typically are aluminum. Extrusion 146*a* includes a slot 146*c* for receiving an end cap (not shown).

FIG. 18 comprises views denoted (*a*) to (*d*) that show examples of shelves that can be used with the wall system of the invention. Typically, the shelves shown in FIG. 18 will be of relatively shallow dimensions (e.g. 6 inches) and are intended to support relatively lightweight items such as pens, pencils, compact discs and other desktop accessories.

The shelves shown in FIGS. 18(*a*) and (*b*) are of a length corresponding to the width of a "module" of the wall system (i.e. the spacing between adjacent vertical posts 28). It is of course to be understood that a single shelf could have a length corresponding to a multiple of a single module width. Each shelf has at respectively opposite ends, a bracket 162 that is shaped to hook into the vertical slot pattern (slots 34) in the vertical posts (on-module).

The shelves shown in FIGS. 18(*c*) and (*d*) on the other hand have a generally T-shaped formation 164 along the rear edge of each shelf so that the shelf can be hooked into an undercut groove provided in the wall section, for example, the groove 148 of a plug-in accessory rail (FIG. 18(*c*)) or an accessory element 86 of the form shown in FIG. 6 (FIG. 18(*d*)). In these cases, the shelf can of course have any appropriate length that can be related or unrelated to the width of a module of the wall system.

Irrespective of their manner of attachment, the shelves can have different profiles, some of which are illustrated in FIG. 18. For example, as seen in FIGS. 18(*a*) and (*c*) the shelves have a relatively plain profile with a shallow groove adjacent the outer edge of the shelf, for example, to accommodate writing instruments. As seen in FIG. 18(*a*), the shelf may be, for example, a plastic moulding or an extrusion (e.g. in aluminum). FIG. 18(*c*) shows an embodiment in which the shelf is formed of two extrusions that are coupled together to form a unitary structure. One of the extrusions, denoted 164*a*, forms the shelf proper, while the other extrusion 164*b* defines the T-shaped formation for engagement in groove 148.

FIG. 18(*d*) shows an example of a shelf that comprises a transparent (e.g. glass) panel 165 is cemented to an extrusion 166 that provides the T-shaped formation referred to previously.

FIG. 18(*b*) shows a shelf that is similar to the shelf of FIG. 18(*a*) except that its top surface is ribbed or grooved to accommodate, say, writing instruments or a group of compact discs. A single shelf having a partly ribbed or grooved surface and a partly plain surface can of course be provided.

Figure 18E:
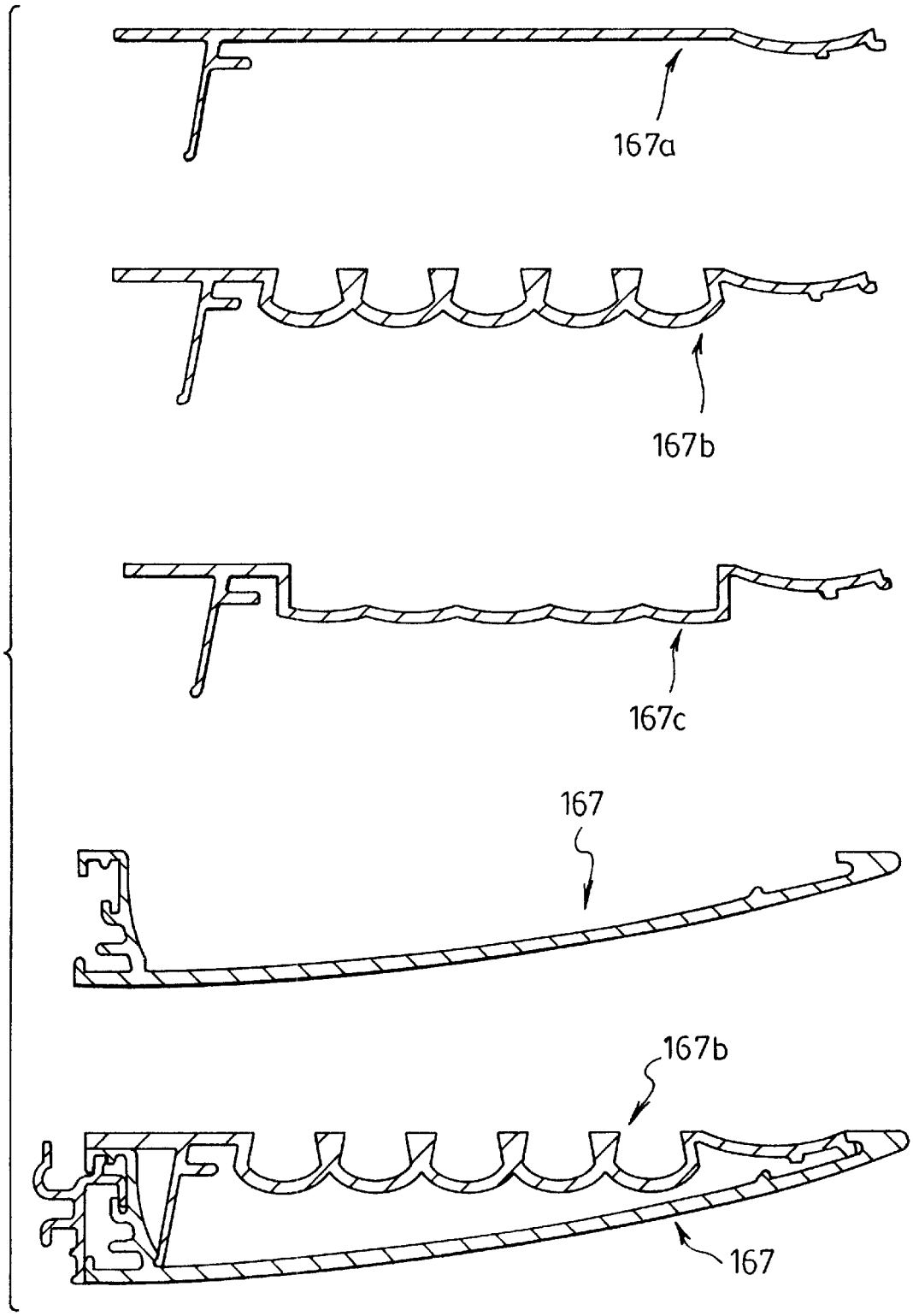

FIG. 18*e* shows an embodiment in which each shelf comprises a lower "carrier" extrusion 167, into which upper extrusions defining alternative shelf sections can be snapped, according to the particular shelf configuration required. Examples of three shelf sections are shown at 167(*a*) to (*c*). The shelves of FIGS. 18(*a*) and (*b*) may be assembled in this fashion.

Figure 19:
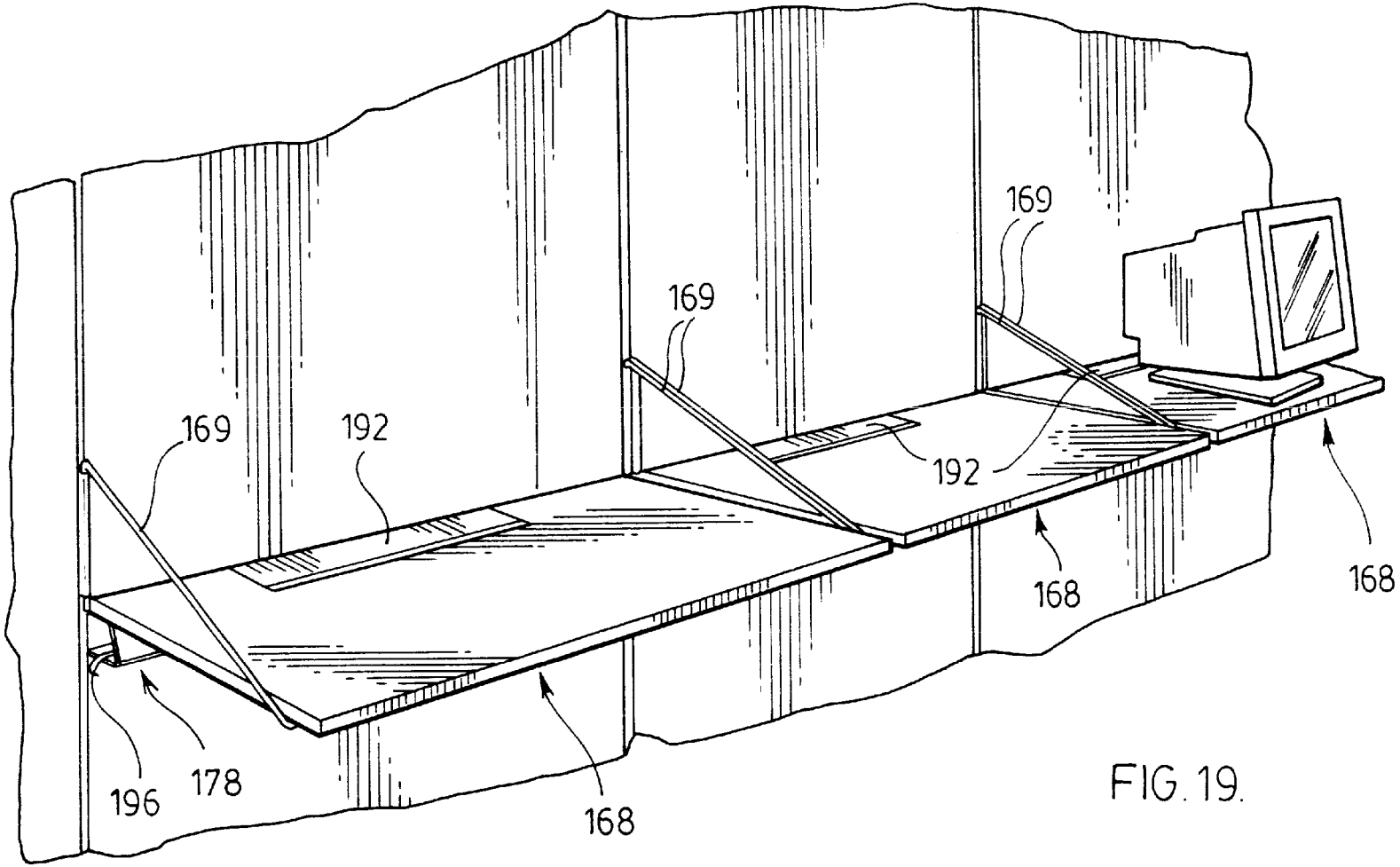
FIG. 19 is a perspective view showing a wall system that includes so-called technology shelves.

FIG. 19 shows a number of side-by-side modules of a wall system in accordance with the invention, in which the modules are fitted with shelves capable of supporting heavier weights than the shelves shown in FIG. 18. Reference numeral 168 in FIG. 19 indicates generally a so-called "technology" shelf capable of supporting a computer, monitor or other relatively heavy item(s). Shelf 168 includes shelf supports that engage the vertical posts 28 of the internal frame of the wall structure. The rear edge of each shelf is supported by respective pins (not visible in FIG. 19) that project inwardly from the posts 28 while the outer edge is supported by the diagonal rods indicated at 169.

Figure 20:
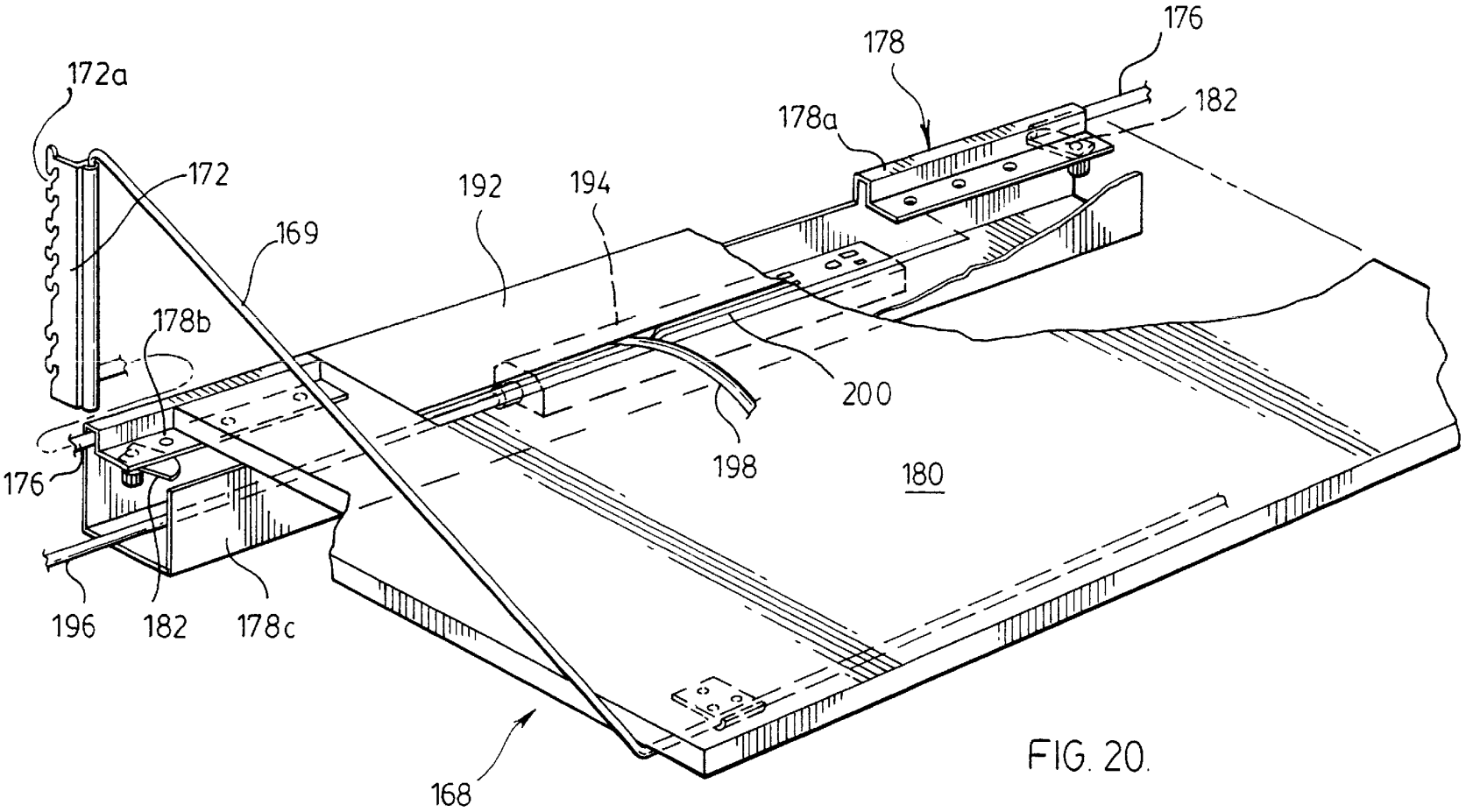

Reverting to FIG. 2, it will be recalled that each of the posts 28 includes, in each of its narrower faces, a series of vertically elongate slots 34 that extend down the length of the face, and rows of threaded openings 30 in its wider faces. When the fascia panels or skins of the wall are in place on the posts, the slots 34 are accessible at both sides of each fascia panel. FIG. 20 shows at one end of shelf 168 a relatively thin metal plate 172 that forms part of each shelf support for the shelf, and which has an outer edge 172*a* especially profiled to provide hook formations for engagement with the openings 34 in the frame posts 28. It can be appreciated from FIGS. 2 and 3 that the number of openings 34 is such that a shelving support can be engaged at virtually any vertical position over the height of the wall. The diagonal rod 169 extends downwardly from the shelf support plate 172 to the outer edge of the shelf and then along below the outer edge and up to the corresponding plate 172 at the other end of the shelf.

The rear edge of the shelf is supported by respective pivot pins 176 that project inwardly from the respective brackets 172 (only one shown) and are received in a channel 178*a* of a formed steel member 178 that extends along the rear edge of the shelf. The shelf has a base 180 of particle board that is secured to member 178 by screws that project through a flange 178*b* extending forwardly from the channel 178*a*. Dislodgement of the shelf is prevented by respective locking plates 182 each mounted on the underside of flange 178*a* by a pin 184 that projects downwardly from the flange. Each pin is threaded and provided with a thumb screw 186 so that the plates can be turned to release the respective pivot pins 176 when the shelf is to be removed (see FIG. 22).

A flip-up door 192 is provided in a rear marginal edge portion of shelf 168 to provide access to a trough for wire management and to a power bar 194. The trough is formed by a lower flange 178*c* of member 178. A wire extending along the trough to the power bar is shown at 196, and a wire extending from the power bar and onto the shelf via door 192 is shown at 198. Flexible edge trim on the shelf opening for door 192 is shown at 200 and allows wires to exit.

Figure 23:
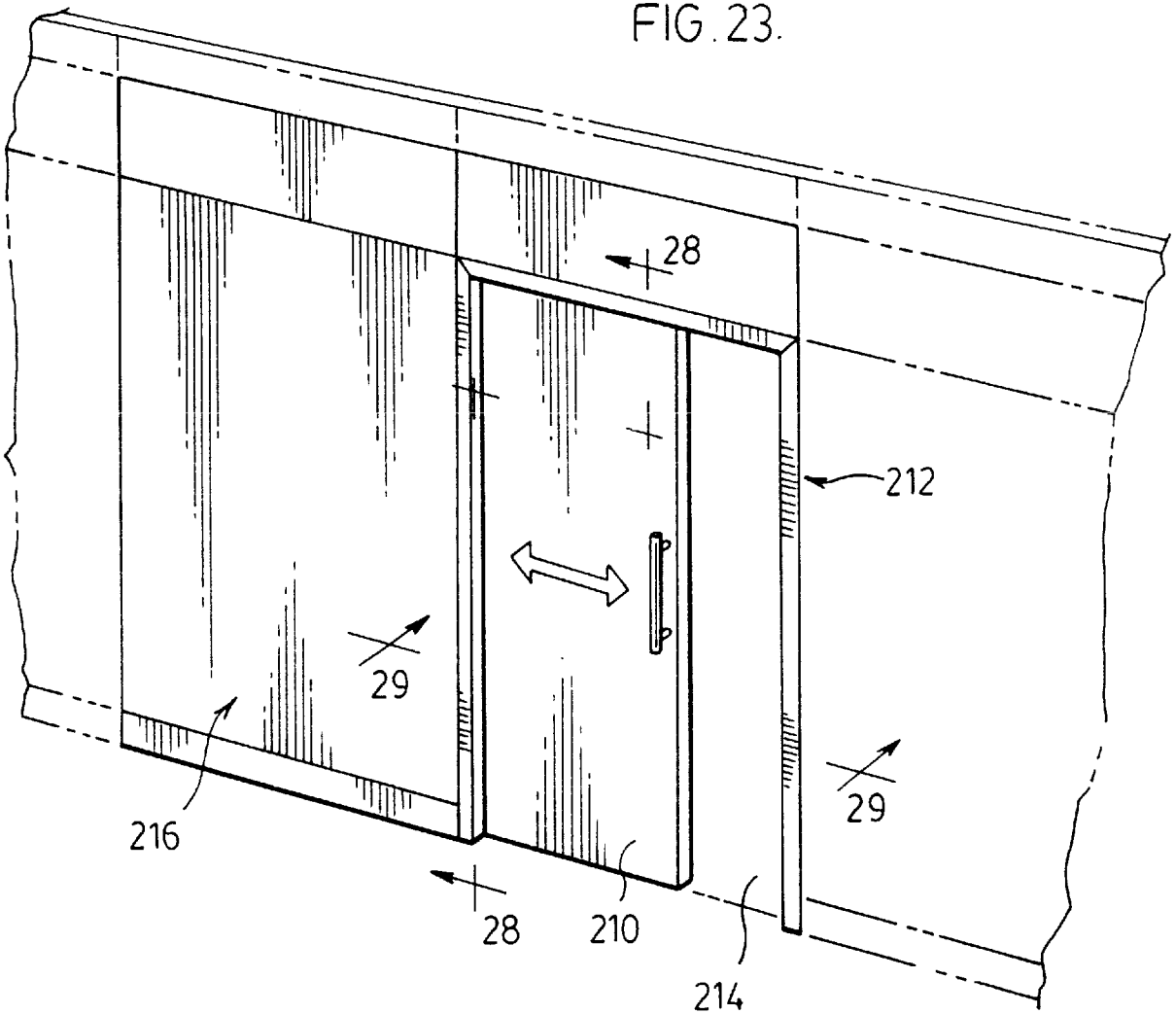
FIG. 23 is a perspective view of a pocket door.

FIGS. 23 to 29 illustrate a pocket door structure that may be used as part of a wall system according to the invention. FIG. 23 shows the structure overall. A solid door finished to match adjacent fascia panels is shown at 210 (though other forms of door may be used). Door 210 has a frame 212 that defines a door opening 214. A wall section 216 adjacent to the door opening incorporates a pocket into which the door 210 can slide.

Figure 24:
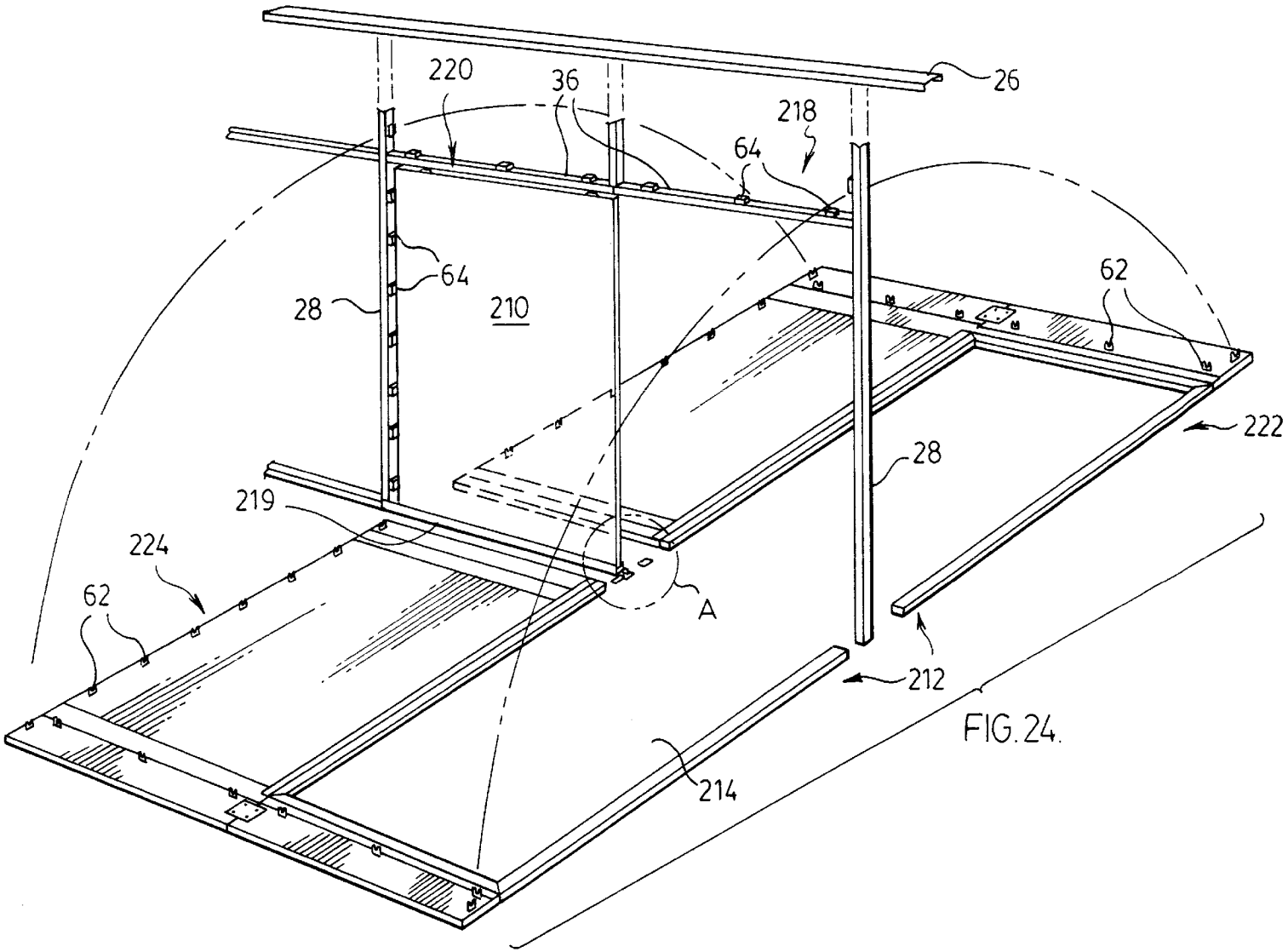
FIG. 24 is a partly exploded view illustrating assembly of the pocket door.
Figure 26:
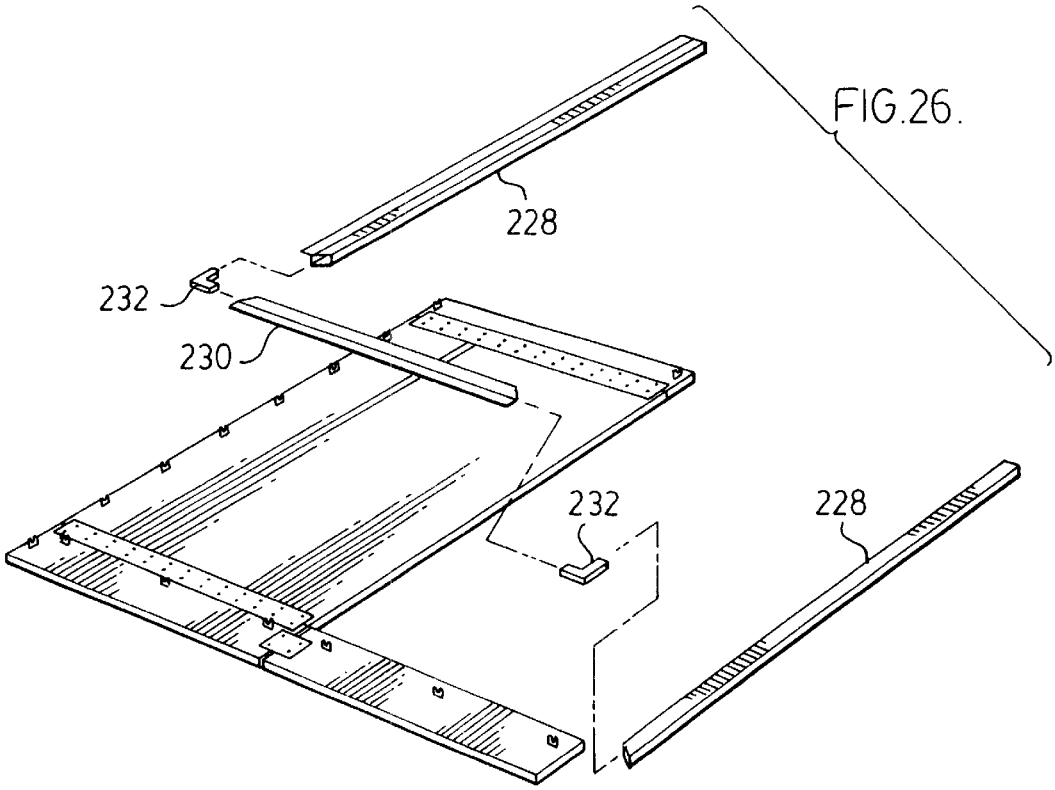
Figure 27:
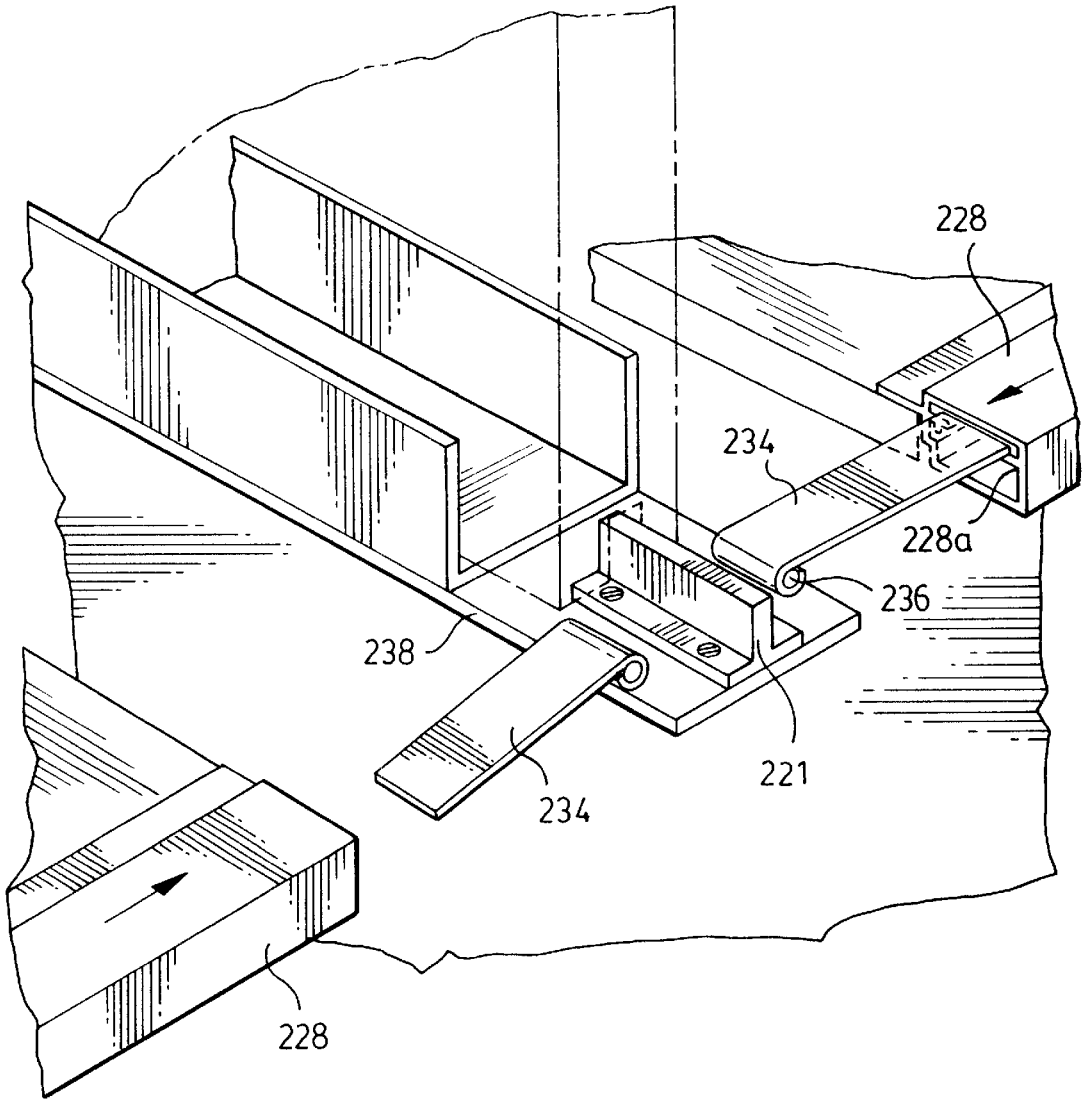
FIG. 27 is an enlarged detail view of the part of FIG. 24 that is indicated at A.
Figure 28:
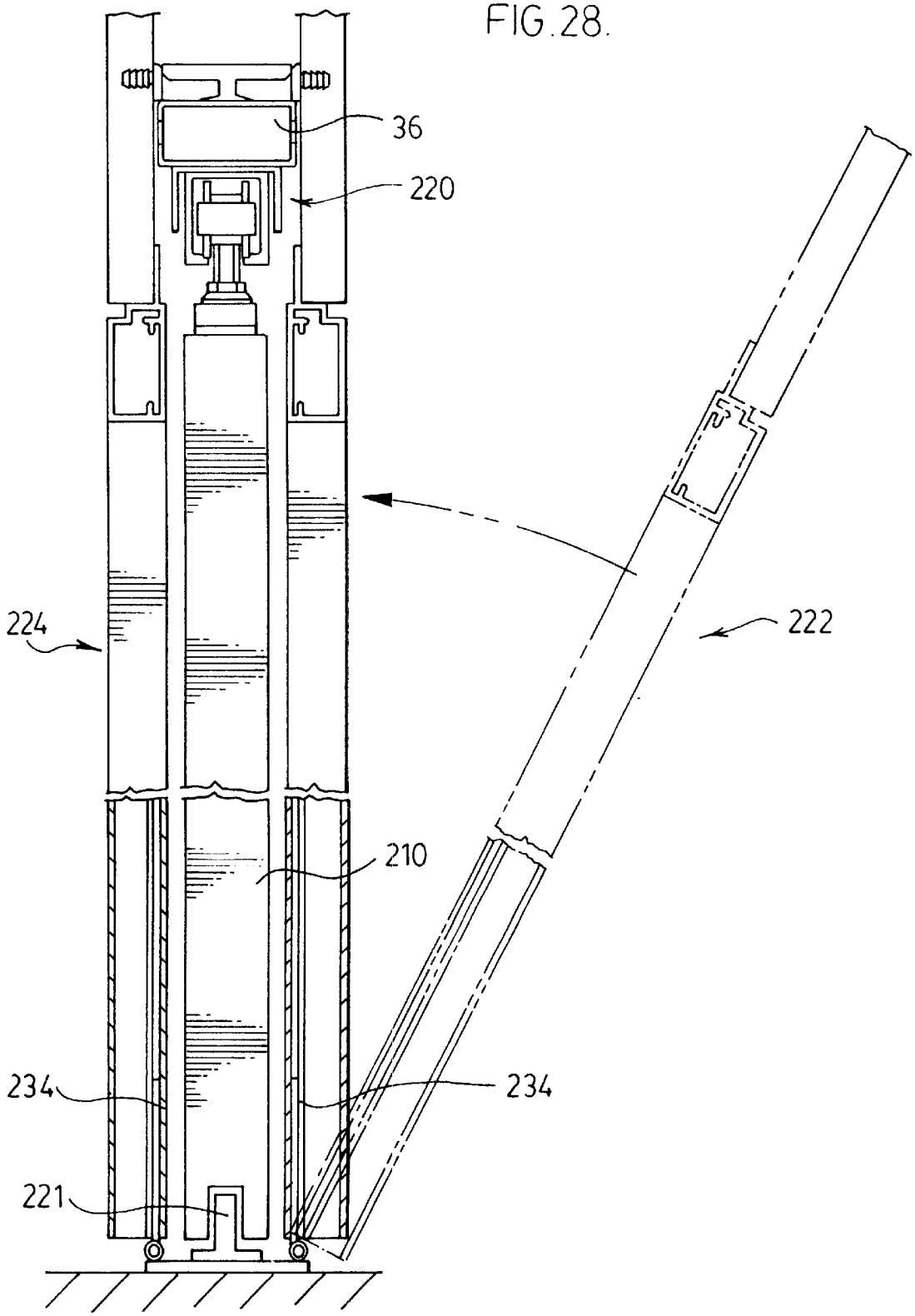
FIG. 28 is a vertical sectional view on line 28—28 of FIG. 23.
Figure 29:
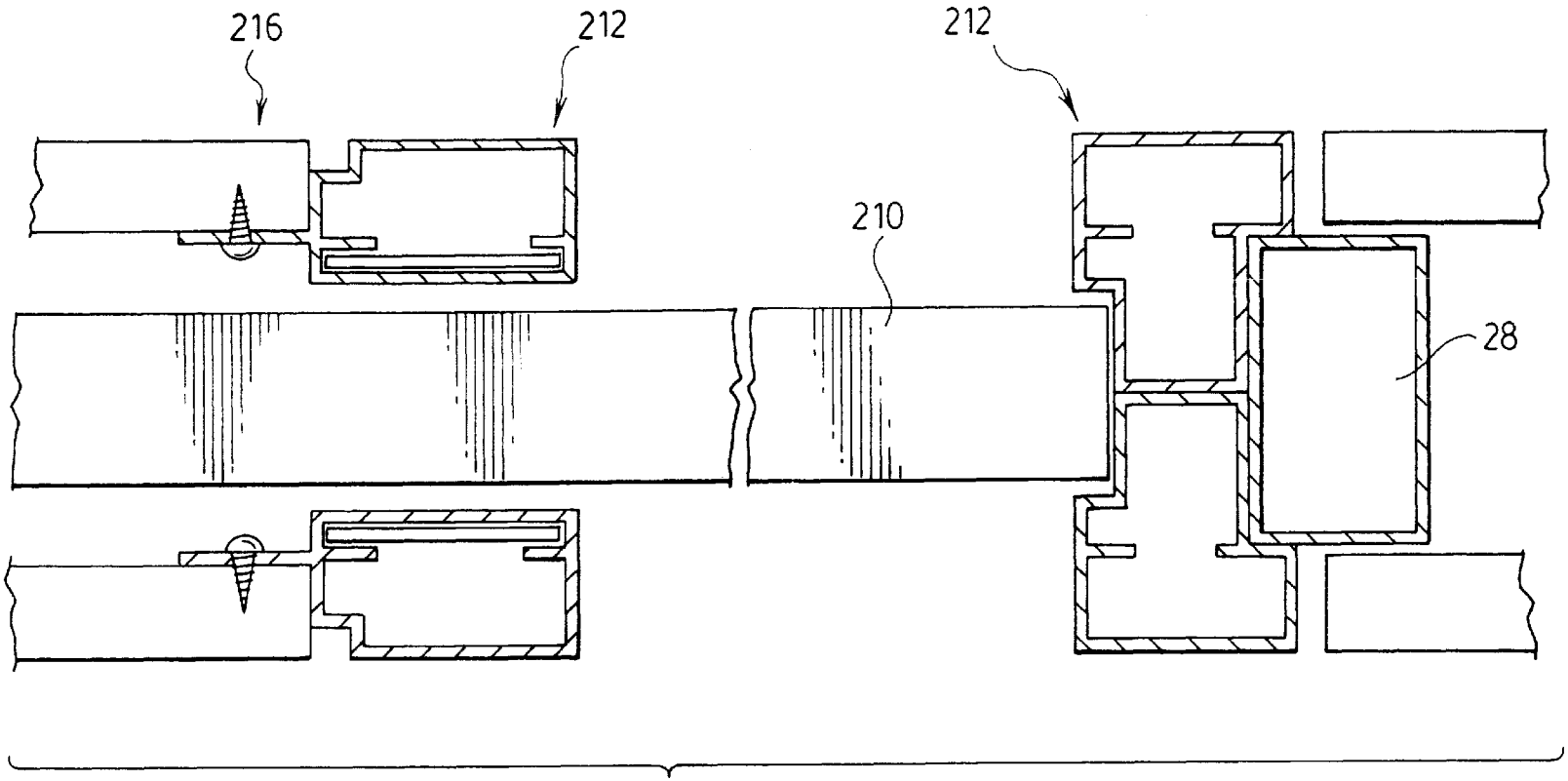
FIG. 29 is a horizontal sectional view on line 29—29 of FIG. 23.

FIGS. 24 to 28 illustrate assembly of the pocket door. As seen in FIG. 24, an upright frame 218 is constructed using vertical posts 28 and horizontal rails 36 of the form described previously. A horizontal base channel 219 is provided on the floor adjacent the door opening 214. The top edge of the door is suspended on a track 220 as shown in FIG. 28. A stationary guide 221 (FIG. 27) projects into a longitudinal groove in the bottom edge of the door, for guiding the door into and out of the pocket.

As seen in FIG. 24, respective fascia assemblies 222, 224 are constructed separately and then lifted into place and snap-fitted to the vertical posts 28 and rails 32 using male and female connectors 62 and 64 of the type described previously.

Figure 25:
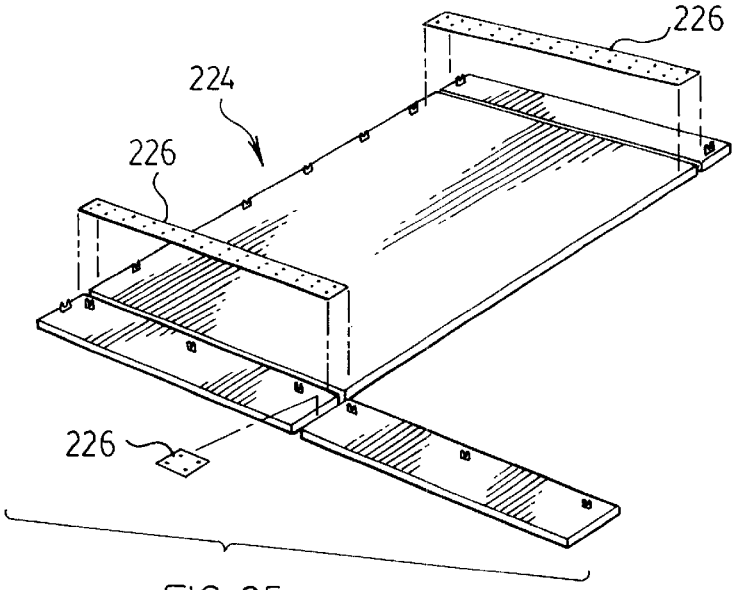
FIGS. 25 and 26 illustrate sub-assemblies of the pocket door.

FIGS. 25 and 26 show assembly of the fascia assemblies 222, 224 by reference to assembly 224. As seen in FIG. 25, a group of fascia panels is laid out in a configuration appropriate to the required configuration of the fascia assembly and the panels are secured together using cover joining plates 226 that are secured in place by screws (not shown). FIG. 26 shows the cover plates in place, and illustrates assembly of door frame trim from a pair of upright members 228, and a cross piece 230 that is coupled to the uprights by corner brackets 232.

FIG. 27 shows parts of two uprights 228 (one from each assembly 22, 224) adjacent the door pocket wall section 216 (FIG. 23). Each upright is an extrusion shaped to define a slot 228*a* capable of slidingly receiving a hinge plate 234 that is pivoted at its distal end to a hinge pin 236 carried by a base plate 238 that also supports the stationary guide 221.

In assembling the fascia assemblies 222, 224 to the upright frame 218 (FIG. 24), the two uprights 228 are engaged with the respective hinge plates 234 so that the respective fascia assemblies are located with respect to the door opening. The assemblies are then successively raised/rotated into position as indicated by the arrow in FIG. 28, associated with fascia assembly 222 and the assembly is secured in place by snap-fitting the male connectors 62 carried by that assembly into the female connector 64 that are carried by frame 218.

Figure 30:
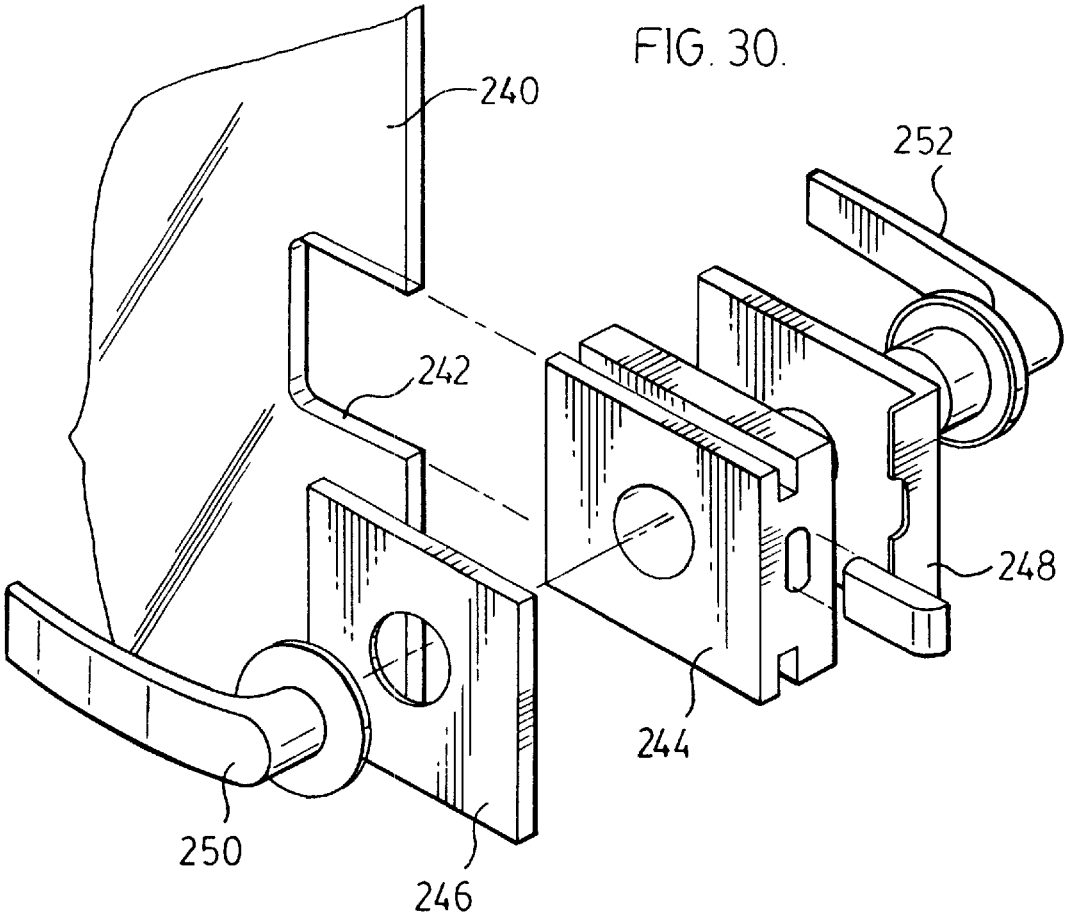
FIG. 30 is an exploded perspective view of a lock set patch plate or spacer for a glass door.

FIG. 30 illustrates a method of adapting a glass door to accommodate a conventional lockset or latchset of North American design using a so-called "patch plate". Part of the door itself is indicated at 240 and has cut-out 242 that receives a slide-in adaptor plate 244, for example, of plastic. The adaptor plate 244 is adhered to the glass door. The plate has a thickness that is selected to accommodate the conventional hardware components of the latch mechanism and to accept respective exterior metal covers 246, 248 and handles 250, 252 of the lock or latchset.

Figure 31:
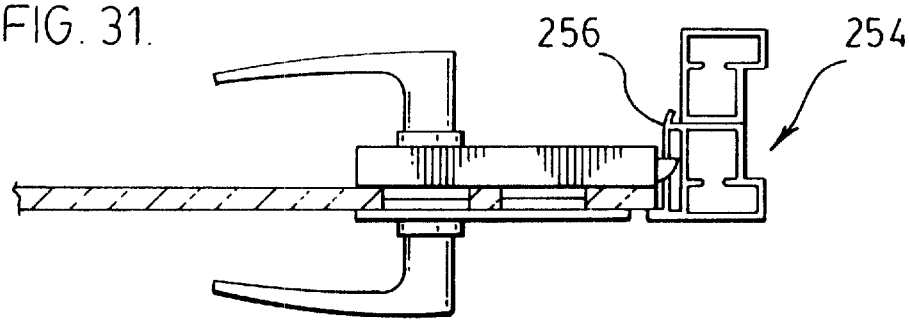
FIG. 31 is a horizontal sectional view through the assembled lock set of FIG. 30 in a door shown in a dosed position.

FIG. 31 is a plan view showing the components of FIG. 30 assembled to the door 240, with the door in a closed position in co-operating relationship with a door jamb 254 that includes a latch striker plate 256.

Finally, FIGS. 32 to 35 illustrate a method of mounting a pivot door in a frame. This method may be applied to a door in a wall system of the form provided by the invention, or to a door in some other form of (e.g. conventional) wall structure.

Figure 32:
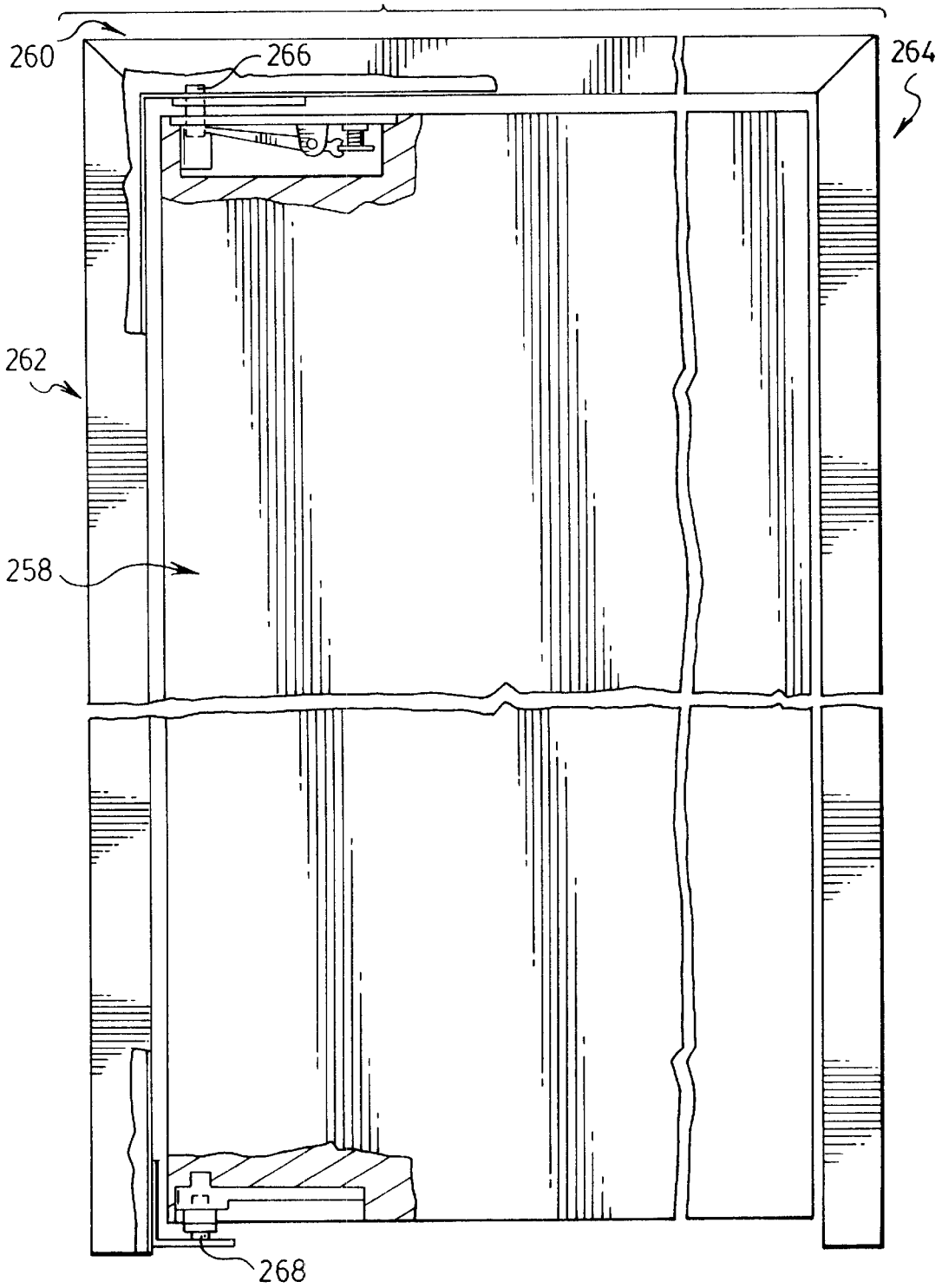
FIG. 32 is an elevational view of a pivot door for use in the wall system of the invention.

As seen in FIG. 32, the door is denoted 258 and is shown mounted in a door frame that includes a header 260 and upright door jambs 262 and 264 respectively. Upper and lower aligned pivot pins 266 and 268 respectively define a pivot axis for the door.

Figure 33:
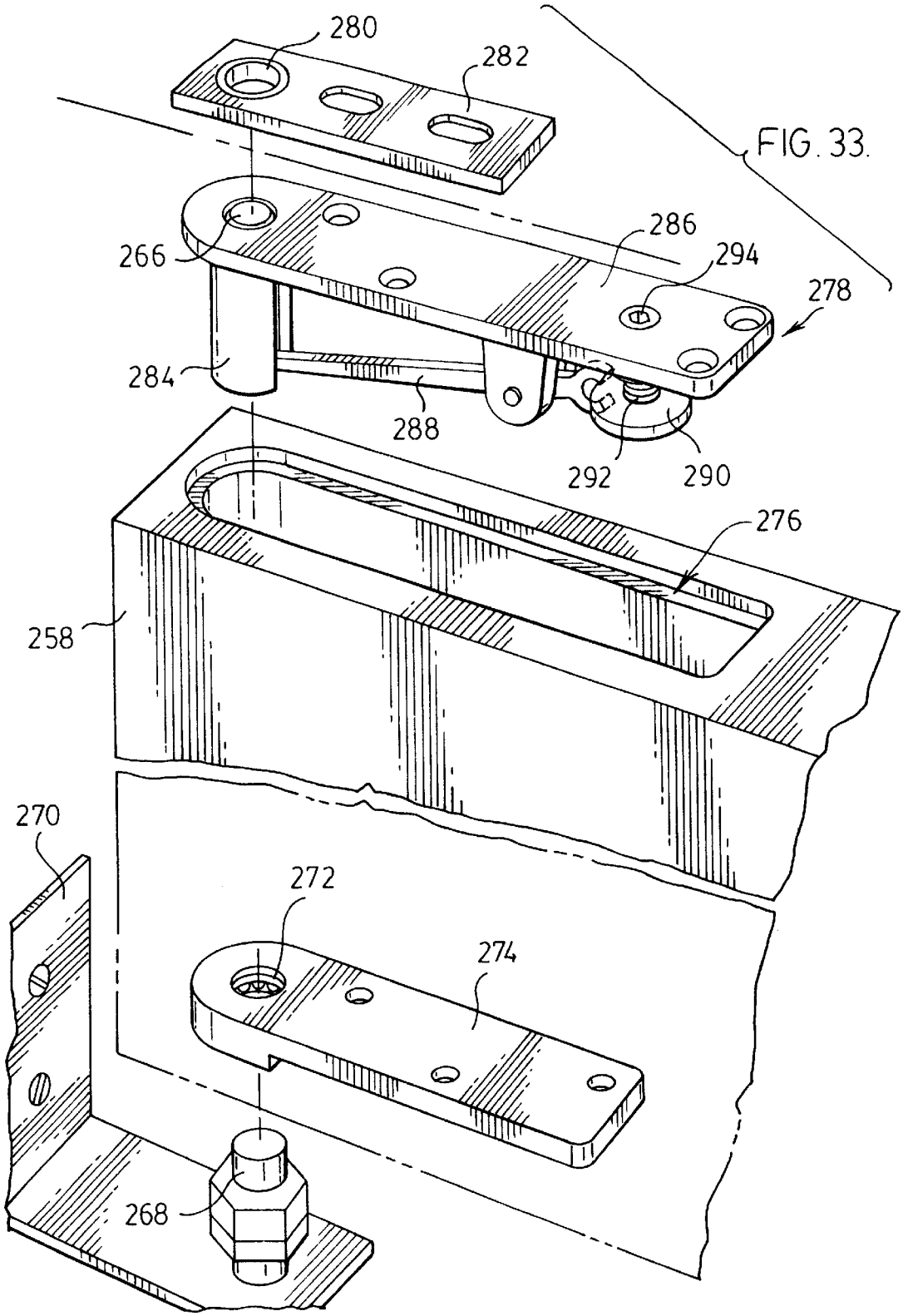
FIG. 33 is an exploded perspective view of the door showing top and bottom pivot mechanisms.

As best seen in FIG. 33, the lower pivot pin 268 is a simple plain pin that is carried by a bracket 270 having an upright limb secured to the door jamb 262. Pin 268 is received in a bearing 272 in one end of a pivot plate 274 that is secured by screws in an appropriately dimensioned recess in the bottom edge of the door.

A corresponding recess 276 is provided in the top edge of the door and is designed to receive a mechanism 278 that includes the top pivot pin 266. As seen in FIG. 33, pivot pin 266 is in a retracted position. However, the pin can be extended vertically as in FIG. 34 to an advanced position in which it projects into a bearing 280 in a pivot plate 282 secured to the underside of the door frame header 260.

It will be appreciated that a difficulty in installing a pivot door is that it is generally not possible to install the door in a frame opening with relatively close tolerances because of the need to provide clearance for the pivot pins. Using the mechanism shown in FIG. 33, this difficulty is avoided because the top pivot pin 266 is retracted until after the door has been positioned in the door opening. This means that the door itself can be made to a much closer tolerance with respect to the door frame, than a conventional pivot door.

Figure 35:
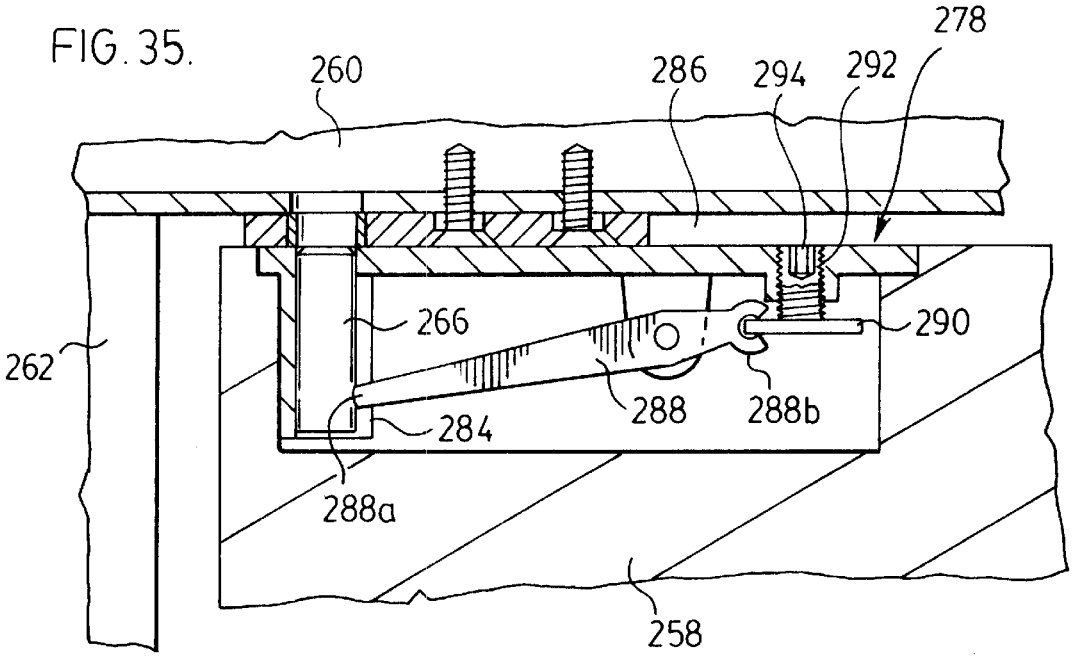

Referring to FIG. 35, it will be seen that the pivot pin 266 is slidably received in a sleeve 284 so that the pin 266 can be advanced and retracted in line with the intended pivot axis of the door. Sleeve 284 extends downwardly from a top plate 286 of mechanism 278. A lever 288 is pivotally mounted to the underside of plate 286 and has a distal end 288*a* that engages pivot pin 266 through a slot in sleeve 284. The opposite end of lever 288 has a C-shaped formation 288*b* that embraces a disc 290 carried by a screw 292 that is threaded into plate 286. At its top end, screw 292 has a socket 294 that is accessible through an opening 296 in plate 286 and that is shaped to receive an Allen key 298.

Figure 34:
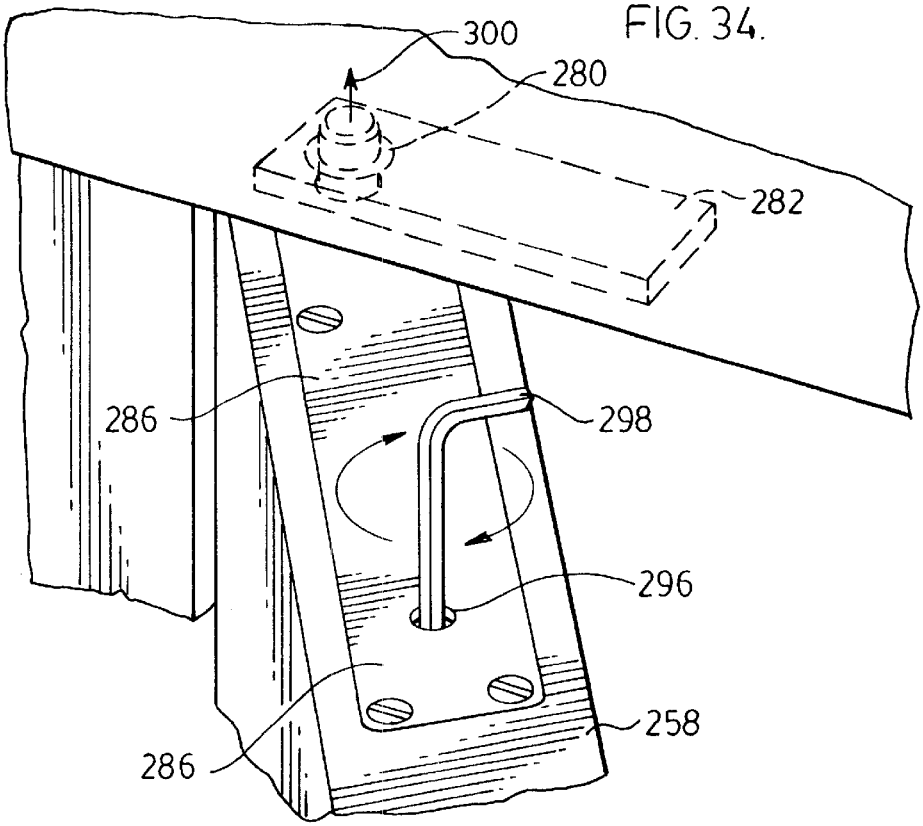
FIG. 34 is a perspective view from above showing the door in a partly open position and illustrating operation of the pivot mechanism shown in FIG. 33; and, FIG. 35 is a vertical sectional view showing the upper pivot mechanism of FIG. 33.

It will be appreciated that turning screw 292 by means of the Allen key 298 in the appropriate direction from the position shown in FIG. 35 has the effect of moving downwardly the C-shaped ends 288*b* of lever 288 and raising the distal end 288*a* of the lever, thereby projecting pivot pin 266 upwardly in the direction indicated by the arrow 300 in FIG. 34.

In summary, to install the door, the pivot pin 266 is initially retracted to the position shown in FIGS. 33 and 35. The door is manipulated to position the bearing 272 in pivot plate 274 at the bottom of the door over pivot pin 268. The door is then swung into position and supported with the door angled outwardly with respect to the door opening, as illustrated in FIG. 34. Allen key 298 is then inserted into screw 292 and is turned in the appropriate direction to raise the pivot pin 266 into bearing 280. When the pin has been fully raised, the Allen key 298 is removed and the door can pivot freely about the two pivot pins 266, 268.

Mechanism 278 is one example of a mechanism that can be used to advance and retract the top pivot pin 266. The particular mechanism has a number of practical advantages including the fact that it is concealed from view in the top edge of the door. Nevertheless, other means could be used to extend and retract the pivot pin 266. For example, a worm drive arrangement could be used instead of the lever mechanism illustrated.

It should finally be noted that the preceding description relates to particular aspects of the invention that may be used individually or in combination. Also, the structures shown are to be regarded as examples; many variations are possible.

We claim:

1. A wall system for partitioning interior space within a building, the system comprising an internal frame having upright posts and transverse rails extending between the posts, and a plurality of panels secured to the frame and forming an external wall covering on the frame;

wherein at least one of said panels comprises, as part of said wall covering, a panel element selected from a tack board, a whiteboard, and an accessory board having at least one transversely extending undercut channel by which an accessory can be coupled to the element;

and wherein the wall system further includes:

a power/data rail extending transversely of the wall structure and including at least one module having plug-in receptacles for power and/or data, wherein the rail provides a lay-in channel for wire management and is defined by a generally C-shaped base extrusion that opens laterally of the wall covering of the wall system and is coupled to said internal frame, said base extrusion receiving said module and providing laterally of said module said lay-in channel for wire management, the power/data rail further including first cover means for said module and second cover means for said lay-in channel laterally outwardly of the module, said base extrusion being positioned so that said second cover means is generally flush with an outer surface of said external wall covering; and, a pivot door installed in an opening in said wall system, wherein the door is pivotally supported in said opening by top and bottom pivot pins that are aligned with one another to define a pivot axis of the door and wherein said top pivot pin is part of a mechanism that includes means supporting the top pivot pin for movement in the direction of said pivot axis between an advanced position in which the pivot pin supports the door in the door opening, and a retracted position in which the pivot pin is withdrawn into the door sufficiently to allow installation and removal of the door from the door opening, and means accessible from externally of the door for moving the pivot pin between its advanced position and its retracted position.

2. A wall system as claimed in claim 1, wherein said first cover means comprises an extrusion pivotally coupled to said base extrusion at an upper location on said base extrusion, whereby said cover means can be lifted to provide access to said module, and wherein said second cover means comprises a further extrusion pivotally coupled to said base extrusion at a lower region thereof so that said second cover means is pivoted downwardly to provide access to said lay-in channel for wire management.

3. A wall system as claimed in claim 1, wherein said means accessible from externally from the pivot door for moving the pivot pin between its advanced position and its retracted position comprise a lever mechanism located within a top edge portion of the door and including a lever having first and second ends and mounted for pivotal movement between said ends, said first end of the lever being coupled to the pivot pin and said second end of the lever being coupled to a screw having a head that is accessible from a top edge of the door, whereby the lever mechanism can be operated to move the pivot pin between its advanced and retracted positions by a tool engaged with said screw.

4. A wall system as claimed in claim 1, wherein said panel element is coupled to said internal frame by a plurality of co-operating male and female coupling members which are carried respectively by the panel elements and the frame and are adapted to snap-fit together.

5. A wall system as claimed in claim 4, wherein said male and female coupling members comprise C-shaped male coupling members carried by the panel element, and complimentary channel-shaped female coupling members carried by lateral surfaces of said internal frame.

6. A wall system as claimed in claim 1, further including at least one of the following further elements:

at least one accessory rail extending transversely between at least two adjacent said posts, the rail having an external surface defining at least one generally horizontal undercut channel adapted to receive an accessory to be coupled to the wall system;

at least one shelf, and means supporting said shelf outwardly of said external wall covering;

a pocket door structure comprising a door mounted for sliding movement in a plane from a closed position in a door opening defined by said frame to an open position laterally adjacent said door opening, wherein said panels forming said wall covering define a hollow wall portion for accommodating the door in said open position;

at least one glass door fitted with a lockset or latchset through the intermediary of an adaptor plate received in a cut-out in the glass door.

7. A wall system as claimed in claim 6, wherein said accessory rail comprises an extrusion defining a plurality of said generally horizontal undercut channels extending parallel to one another longitudinally of the rail, and means for coupling the extrusion to the posts of the internal frame of the wall system comprising respective hook-shaped formations extending rearwardly from said extrusion adjacent respectively opposite ends thereof, for engagement with corresponding projections on lateral faces of said posts.

8. A wall system as claimed in claim 6, wherein said means supporting said shelf comprise respective brackets adjacent respectively opposite ends of said shelf engageable with respective upright posts of the internal frame of the wall system for supporting the shelf on said posts.

9. A wall system as claimed in claim 8, wherein said brackets are coupled to an outer edge of said shelf by respective support rods that extend downwardly from said brackets to said edge, and wherein an inner edge of the shelf is supported on respective pins that extend inwardly from said brackets.

10. A wall system as claimed in claim 6, wherein said means supporting said shelf comprises a T-section formation extending along a rear edge of the shelf and engageable with a complimentary undercut channel that extends transversely of the wall covering of the wall system.

11. A wall system as claimed in claim 6, wherein said internal frame of the wall system is arranged to define an unobstructed space that includes said door opening and hollow wall portion for permitting unobstructed movement of the door between its said open and closed positions, and wherein said wall covering defining said hollow wall portion comprises respective fascia assemblies that are coupled to opposite sides of said internal frame and that include trim elements defining said door opening.

12. A wall system as claimed in claim 11, wherein each of said fascia assemblies is pivotally supported at a lower end thereof, whereby the assembly can be constructed in a flat configuration and pivotally raised into abutment with the internal frame, and wherein the fascia assemblies and internal frame are coupled together by respective male and female coupling members that snap together for securing the fascia assemblies to the frame.

13. A wall system as claimed in claim 6, wherein the adaptor plate accommodates internally conventional hardware components of the lockset or latchset, and is adapted externally to accept exterior components of the lockset or latchset, including handles.

* * * * *